US008270877B2

(12) United States Patent
Tomatsu et al.

(10) Patent No.: US 8,270,877 B2
(45) Date of Patent: Sep. 18, 2012

(54) IMAGE FORMING APPARATUS

(75) Inventors: Yoshiya Tomatsu, Kasugai (JP); Yohei Hashimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 316 days.

(21) Appl. No.: 12/748,950

(22) Filed: Mar. 29, 2010

(65) Prior Publication Data

US 2010/0272470 A1 Oct. 28, 2010

(30) Foreign Application Priority Data

Apr. 28, 2009 (JP) ..... 2009-109003
Sep. 29, 2009 (JP) ..... 2009-224757

(51) Int. Cl.
*G03G 15/00* (2006.01)

(52) U.S. Cl. ..... 399/167

(58) Field of Classification Search ..... 399/167
See application file for complete search history.

(56) References Cited

U.S. PATENT DOCUMENTS

| | | | | |
|---|---|---|---|---|
| 6,907,212 | B2 * | 6/2005 | Harada et al. | 399/167 |
| 7,920,807 | B2 | 4/2011 | Tomatsu | |
| 7,925,181 | B2 | 4/2011 | Hattori et al. | |
| 2002/0110388 | A1 | 8/2002 | Yokomori et al. | |
| 2002/0172531 | A1 | 11/2002 | Harada et al. | |
| 2005/0191092 | A1 | 9/2005 | Toso et al. | |
| 2008/0138113 | A1 * | 6/2008 | Murrell et al. | 399/167 |
| 2008/0138114 | A1 * | 6/2008 | Chadani et al. | 399/167 |
| 2009/0169247 | A1 | 7/2009 | Hattori | |
| 2009/0169253 | A1 | 7/2009 | Kamimura et al. | |
| 2009/0220273 | A1 | 9/2009 | Tomatsu | |
| 2009/0304412 | A1 | 12/2009 | Hattori et al. | |
| 2011/0150528 | A1 | 6/2011 | Tomatsu | |

FOREIGN PATENT DOCUMENTS

| | | |
|---|---|---|
| JP | 10-111589 | 4/1998 |
| JP | 10-254327 | 9/1998 |
| JP | 2000-276032 | 10/2000 |
| JP | 2002-156886 | 5/2002 |
| JP | 2002-304106 | 10/2002 |
| JP | 2002-341696 A | 11/2002 |
| JP | 2003-186348 | 7/2003 |

(Continued)

OTHER PUBLICATIONS

JP Office Action dated Aug. 30, 2011, corresponding JP Application No. 2009-224757; English Translation.

*Primary Examiner* — David Gray
*Assistant Examiner* — G. M. Hyder
(74) *Attorney, Agent, or Firm* — Banner & Witcoff, Ltd.

(57) ABSTRACT

An apparatus includes: a main body; a moving member movable between an accommodation position and a separation position; a driving member rotatably provided in the main body; a passive member rotatably provided in the moving member and is opposed to the driving member in a rotation axis direction; and a driving force transmitting member provided between the driving member and the passive member. The driving force transmitting member is movably supported in the driving member along the rotation axis direction, a first connecting unit is engaged with the driving member and the driving force transmitting member by an unevenness so as to be movable in a first diameter direction, and a second connecting unit is engaged with the driving force transmitting member and the passive member by an unevenness so as to be movable in a second diameter direction.

18 Claims, 13 Drawing Sheets

FOREIGN PATENT DOCUMENTS

| | | | |
|---|---|---|---|
| JP | 2005-107413 | | 4/2004 |
| JP | 2004-145076 | | 5/2004 |
| JP | 2004-264688 | | 9/2004 |
| JP | 2005-241946 | | 9/2005 |
| JP | 2005-265951 | | 9/2005 |
| JP | 2006-214567 | A | 8/2006 |
| JP | 2006-313211 | A | 11/2006 |
| JP | 2008-309872 | A | 12/2008 |
| JP | 2009-162913 | A | 7/2009 |
| JP | 2009-162914 | A | 7/2009 |
| JP | 2009-162915 | A | 7/2009 |
| JP | 2009-210631 | A | 9/2009 |

* cited by examiner

IMAGE FORMING APPARATUS

CROSS REFERENCE TO RELATED APPLICATION

The present application claims priority from Japanese Patent Application No. 2009-109003, which was filed on Apr. 28, 2009, and Japanese Patent Application No. 2009-224757, which was filed on Sep. 29, 2009, the disclosures of which are herein incorporated by reference in its entirety.

TECHNICAL FIELD

The apparatuses and devices consistent with the present invention relate to an image forming apparatus that includes a moving member movable relative to an apparatus main body and a mechanism for transferring the driving force from the apparatus main body to a passive member provided in the moving member.

BACKGROUND

There is a related art image forming apparatuses that include a photosensitive drum carrying a toner image and rotating, and a driving coupling for transferring the driving force to the photosensitive drum. According to this related art image forming apparatus, the driving coupling is capable of advancing and retreating in an axis direction, so it is attached to and detached from an aperture formed on the end of the photosensitive drum, and when the driving coupling is attached to the photosensitive drum, the driving coupling and the photosensitive drum are engaged with each other in the circumferential direction and rotate integrally.

SUMMARY

However, in a case where the cartridge having the photosensitive drum has a structure that can be attached and detached with respect to the apparatus main body, the cartridge is sometimes attached to the apparatus main body in a state in which the center axis of the photosensitive drum is deviated from the center axis of the driving coupling. In this case, in the above-described related art apparatus, even when the driving coupling is inserted in the aperture formed on the end of the photosensitive drum, the driving coupling is pushed into one side of the inner peripheral surface of the aperture of the photosensitive drum and is strongly dashed thereto, so the driving force is not satisfactorily transmitted.

Therefore, an object of the present invention is to provide an image forming apparatus that can satisfactorily transfer the driving force, even when the center axis of a passive member (e.g., photosensitive drum), which is provided rotatably in the moving member that is movable relative to the apparatus main body, is deviated from the center axis of a main body driving member (e.g., driving coupling) provided rotatably in the apparatus main body.

According to an illustrative aspect of the present invention, there is provided an image forming apparatus comprising: an apparatus main body; a moving member that is movable between an accommodation position in the apparatus main body and a separation position out of the apparatus main body; a main body driving member that is rotatably provided in the apparatus main body and to which a driving force of a driving source is transmitted; a passive member that is rotatably provided in the moving member and is opposed to the main body driving member in a rotation axis direction of the main body driving member when the moving member is positioned at the accommodation position; and a driving force transmitting member that is provided between the main body driving member and the passive member, the driving force transmitting member configured to transmit the driving force from the main body driving member to the passive member by engaging with the main body driving member and the passive member in the rotation direction, wherein the driving force transmitting member is movably supported in the main body driving member along the rotation axis direction so as to switch a connection or disconnection of the driving force transmitting member and the passive member, wherein a first connecting unit, by which the main body driving member engages with the driving force transmitting member in the rotation direction, is engaged with the main body driving member and the driving force transmitting member by an unevenness so as to be movable in a first diameter direction perpendicular to the rotation axis direction, and wherein a second connecting unit, by which the driving force transmitting member engages with the passive member in the rotation direction, is engaged with the driving force transmitting member and the passive member by an unevenness so as to be movable in a second diameter direction perpendicular to the rotation axis direction and the first diameter direction.

According to the illustrative aspect of the present invention, even when the center axis of the passive member is deviated from the center axis of the main body driving member, the driving force transmitting member is movable in a first diameter direction and a second diameter direction perpendicular thereto in a state in which the driving force transmitting member is engaged with the passive member and the main body driving member by means of an unevenness. Thus, while sliding, the driving force transmitting member transmits the power to the passive member and the main body driving member like an Oldham coupling. As a result, it is possible to satisfactorily transmit the driving force from the main body driving member via the driving force transmitting member to the passive member.

According to the illustrative aspect of the present invention, even when the center axis of the passive member, which is provided rotatably in the moving member that is movable relative to the apparatus main body, is deviated from the center axis of the main body driving member that is provided rotatably in the apparatus main body, it is possible to satisfactorily transfer the driving force by the driving force transmitting member that is movable in the first diameter direction and the second diameter direction.

According to another illustrative aspect of the present invention, there is provided an image forming apparatus comprising: an apparatus main body; a moving member that is movable between an accommodation position in the apparatus main body and a separation position out of the apparatus main body; a main body driving member that is rotatably provided in the apparatus main body and to which a driving force of a driving source is transmitted; a passive member that is rotatably provided in the moving member and is opposed to the main body driving member in an axial direction of the main body driving member when the moving member is positioned at the accommodation position; and a driving force transmitting member that is disposed between the main body driving member and the passive member, the driving force transmitting member transmitting the driving force from the main body driving member to the passive member by engaging with the main body driving member and the passive member in the rotation direction, wherein the driving force transmitting member is configured to be movable to the main body driving member along the axial direction so as to switch a connection or a disconnection of the driving force transmitting member and the passive member, wherein the driving force transmitting member includes: a coupling member that is disposed in a position close to the main body driving member; and an Oldham member that is disposed at a position close to the passive member, wherein the coupling member is supported in the main body driving member so as to be movable along the axial direction and is engaged with the main body driving member in the rotation direction, wherein the Oldham member is attached on the coupling member so as to be movable along the axial direction with the coupling member, the Oldham member is configured to be engageable with the coupling member and the passive member in the rotation direction, wherein a first connecting unit, by which the coupling member engages with the Oldham member in the rotation direction, is engaged with the coupling member and the Oldham member by an unevenness so as to be movable in a first diameter direction perpendicular to the axial direction, and wherein a second connecting unit, by which the Oldham member engages with the passive member in the rotation direction, is engaged with the Oldham member and the passive member by an unevenness so as to be movable in a second diameter direction perpendicular to the axial direction and the first diameter direction.

According to another illustrative aspect of the present invention, even when the center axis of the passive member is deviated from the center axis of the main body driving member, the Oldham member is movable in a first diameter direction and a second diameter direction perpendicular thereto in a state in which the Oldham member is engaged with the passive member and the coupling member by means of an unevenness. Thus, while sliding, the Oldham member transmits the power to the passive member and the coupling member like an Oldham's coupling. As a result, it is possible to satisfactorily transmit the driving force from the main body driving member via the driving force transmitting member to the passive member.

According to another aspect of the present invention, even when the center axis of the passive member is deviated from the center axis of the main body driving member, it is possible to satisfactorily transmit the driving force by the Oldham member that is movable in the first diameter direction and the second diameter direction.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Next, a first exemplary embodiment of the present invention will be described in detail with reference to the drawings. In the following description, first of all, the overall structure of a color laser printer as one example of an image forming apparatus relating to one embodiment will be briefly described in FIG. 1.

Overall Structure of Color Laser Printer

Figure 1:
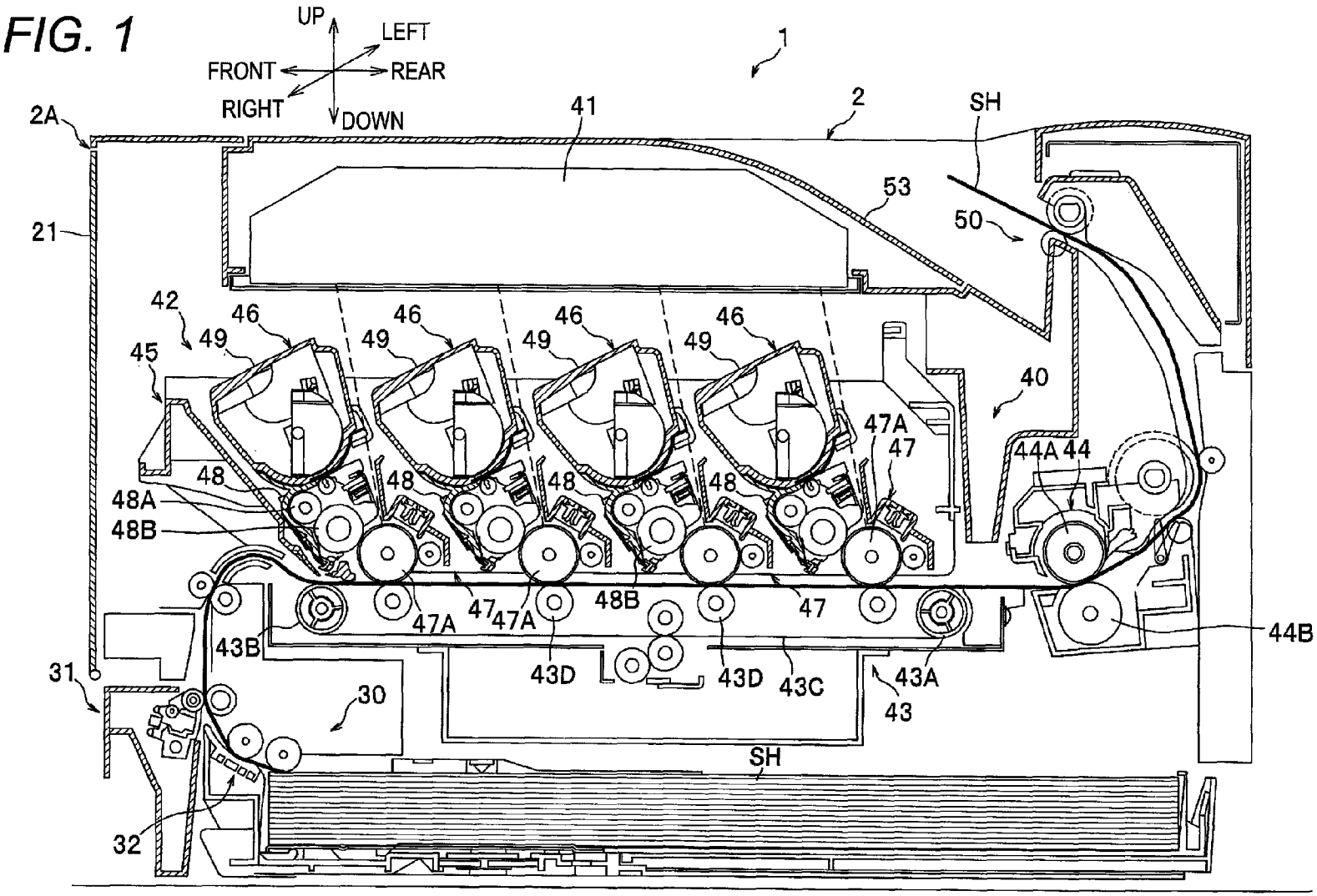
FIG. 1 is a sectional view showing the overall structure of a color laser printer according to one embodiment of the present invention.

As shown in FIG. 1, a color laser printer 1 includes a paper feeding portion 30 for feeding recording sheets SH into an apparatus main body 2, an image forming unit 40 for forming images on the recording sheets SH which have been fed from the paper feeding portion 30, and a paper discharging portion 50 that discharges the recording sheets SH, which have been formed with images by the image forming unit 40, from the apparatus main body 2.

In addition, directions of up and down, left and right, and front and rear indicated by arrows in FIG. 1 are directions as seen from a person who stands in front of the color laser printer 1. Unless particularly described, in the following description, the directions of up and down, left and right, and front and rear are on the basis of the directions indicated by the arrows in FIG. 1.

In a front wall of the apparatus main body 2, an opening portion 2A for attaching and detaching a drawer 45 as one example of a moving member described later is formed and a front cover 21 for opening and closing the opening portion 2A is installed so as to be rotated.

The paper feeding portion 30 includes a paper feeding tray 31 that can be attached to and detached from to the apparatus main body 2, and a paper feeding mechanism 32 for transporting the recording sheets SH from the paper feeding tray 31 to the image forming unit 40. The paper feeding mechanism 32 has paper feeding rollers, separating rollers, and separating pads or the like (not shown) and separately transports the recording sheets SH in the paper feeding tray 31 to the upper image forming unit 40 one by one.

The image forming unit 40 includes a scanner portion 41, a process portion 42, a transfer portion 43 and a fixing portion 44.

While it is not shown, the scanner portion 41 includes a laser emitting portion, a polygon mirror, a plurality of lenses and reflectors. In the scanner portion 41, laser lights corresponding to each of colors of cyan, magenta, yellow and black are illuminated to each of the photosensitive drums 47A of the process portion 42.

Figure 2:
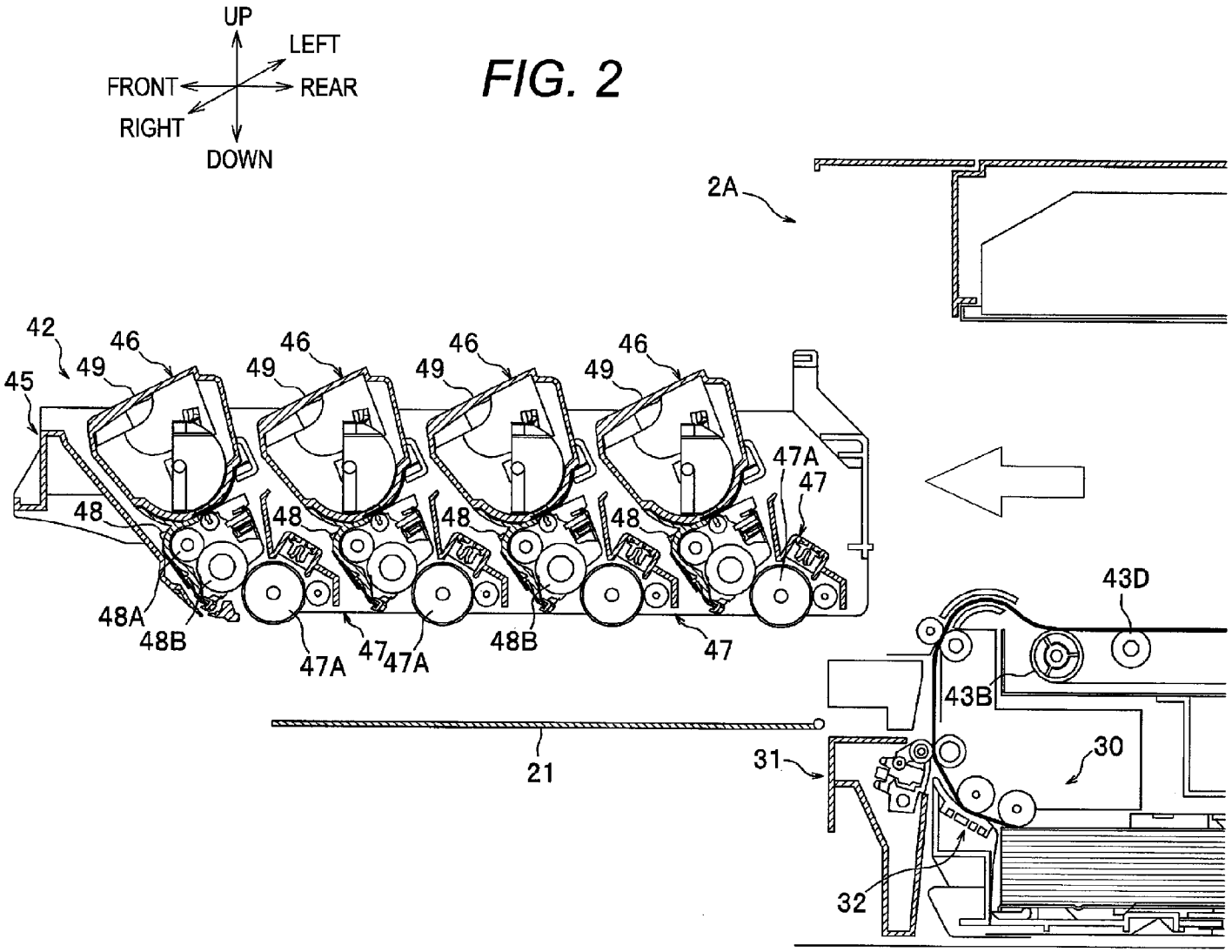
FIG. 2 is a sectional view showing a state in which a drawer is withdrawn from an apparatus main body.

The process portion 42 includes a drawer 45 which is disposed between the scanner portion 41 and the transfer portion 43 and is detachably mounted in the apparatus main body 2. The drawer 45 can be moved between an accommodation position (position of FIG. 1) in the apparatus main body 2 and a separation position (position of FIG. 2) out of the apparatus main body 2, in a state in which the front cover 21 is opened. In addition, in the drawer 45, four (plural) process cartridges 46 are arranged along the transport direction of the recording sheets SH.

Each of the process cartridges 46 includes a drum sub unit 47 disposed at a lower portion, a development unit 48 that is detachably connected to the drum sub unit 47, and a developing agent cartridge 49 that is detachably connected to the development unit 48.

The drum sub unit 47 includes a photosensitive drum 47A as one example of a passive member (photoreceptor) and a scorotron-type charger (not shown) or the like. The photosensitive drum 47A is rotatably supported to the drum sub unit 47. In other words, the photosensitive drum 47A is indirectly supported to the drawer 45 via the drum sub unit 47.

The development unit 48 includes a development roller 48B and a supplying roller 48A or the like. In addition, in the developing agent cartridges 49, toners (developing agents) of a nonmagnetic one component of each color of cyan, magenta, yellow and black are accommodated.

In the process portion 42 configured as above, the surface of the photosensitive drum 47A charged by the scorotron-type charger is exposed by the laser light emitted from the scanner portion 41, so the electric potential of the exposed portion is lowered and electrostatic latent image based on image data is formed on the photosensitive drum 47A. In addition, the toner, which has been charged by the development roller 48B contacting the photosensitive drum 47A, is supplied to the electrostatic latent image on the photosensitive drum 47A, so the toner image is carried on the photosensitive drum 47A.

The transfer portion 43 includes a driving roller 43A, a driven roller 43B, a transport belt 43C and a transfer roller 43D.

The transport belt 43C is disposed opposite to a plurality of photosensitive drums 47A. The transport belt 43C is driven for rotation together with the driven roller 43B, by means of the rotation driving of the driving roller 43A. In addition, a transfer roller 43D is disposed at the inner side of the transport belt 43C and each photosensitive drum 47A and the transfer roller 43D sandwich the transport belt 43C therebetween. A transfer bias from a high pressure substrate (not shown) is applied to the transfer roller 43D.

In addition, in the transfer portion 43, when the recording sheets SH transported by the transport belt 43C are supplied between the photosensitive drum 47A and the transfer roller 43D, the toner image on the photosensitive drum 47A is transcribed onto the recording sheets SH.

The fixing portion 44 includes a heating roller 44A and a pressing roller 44B. In the fixing portion 44, the recording sheets SH are transported while being interposed between the heating roller 44A and the pressing roller 44B, so toner images on the recording sheets SH are subjected to the heat fixing.

The paper discharging portion 50 has a plurality of transport rollers (not shown) and transports the recording sheets SH which have been discharged from the fixing portion 44 to the upper paper discharging tray 53.

Driving Force Transmitting Mechanism to Photosensitive Drum

Next, a driving force transmitting mechanism to the photosensitive drum 47A which is a characteristic portion of the present invention will be described.

Figure 3A:
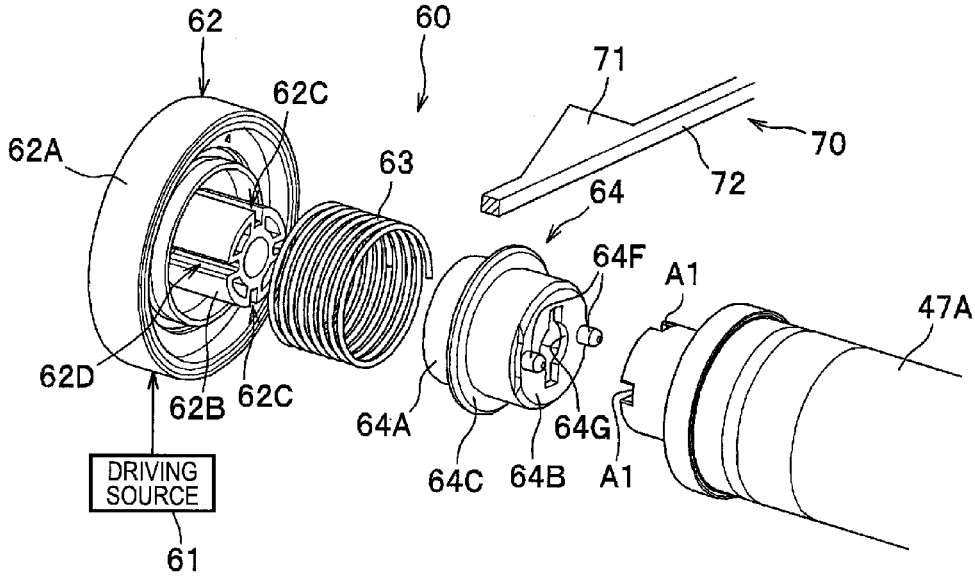
FIG. 3A is an exploded perspective view in which the driving force transmitting mechanism is disassembled when viewed from a photosensitive drum side.

As shown in FIG. 3A, a driving force transmitting mechanism 60 for transmitting the driving force to photosensitive drum 47A includes a driving source 61 such as a motor, a main body driving gear 62 as one example of the main body driving member, a coil spring 63 as one example of the pressing member, and a coupling 64 as one example of a driving force transmitting member.

The driving source 61 is installed at a suitable position of the apparatus main body 2 and transmits directly the driving force to the main body driving gear 62 or transmits indirectly to the main body driving gear 62 by being connected via predetermined numbers of gears.

Figure 4A:
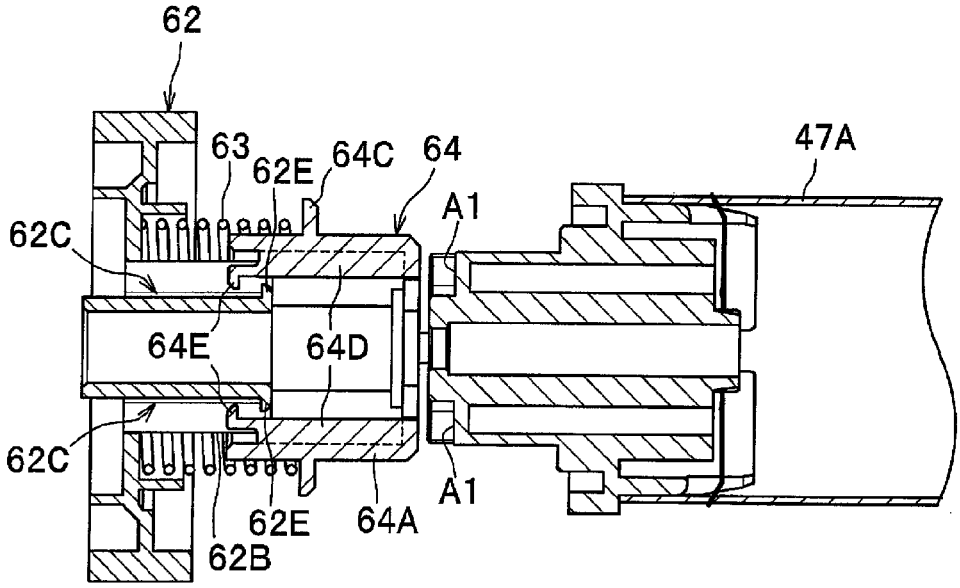
FIG. 4A is a sectional view of the driving force transmitting mechanism taken from a first diameter direction.

The main body driving gear 62 is rotatably installed in the apparatus main body 2 and mostly includes a gear portion 62A to which a driving force is transmitted from the driving source 61, and a protrusion 62B protruded from the center portion of the gear portion 62A toward the coupling 64. On the outer peripheral surface of the protrusion 62B, a pair of first concave portions 62C is installed along the rotation axis direction of the main body driving gear 62 so as to be opposed to each other with the rotation axis interposed therebetween. In addition, a pair of concave portions 62D formed between each of the first concave portions 62C among the outer peripheral surfaces of the protrusion 62B is formed in consideration of the symmetry (rotation balance of the main body driving gear 62) for improving the gear accuracy In addition, as shown in FIG. 4A, at the ends of each of the first concave portions 62C facing the coupling 64, catching ribs 62E as one example of catching portions, which protrude outward in the diameter direction of the main body driving gear 62, are each formed.

The coil spring 63 is disposed between the main body driving gear 62 and the coupling 64 and presses the main body driving gear 62 and the coupling 64 in a direction separated from each other.

Figure 3B:
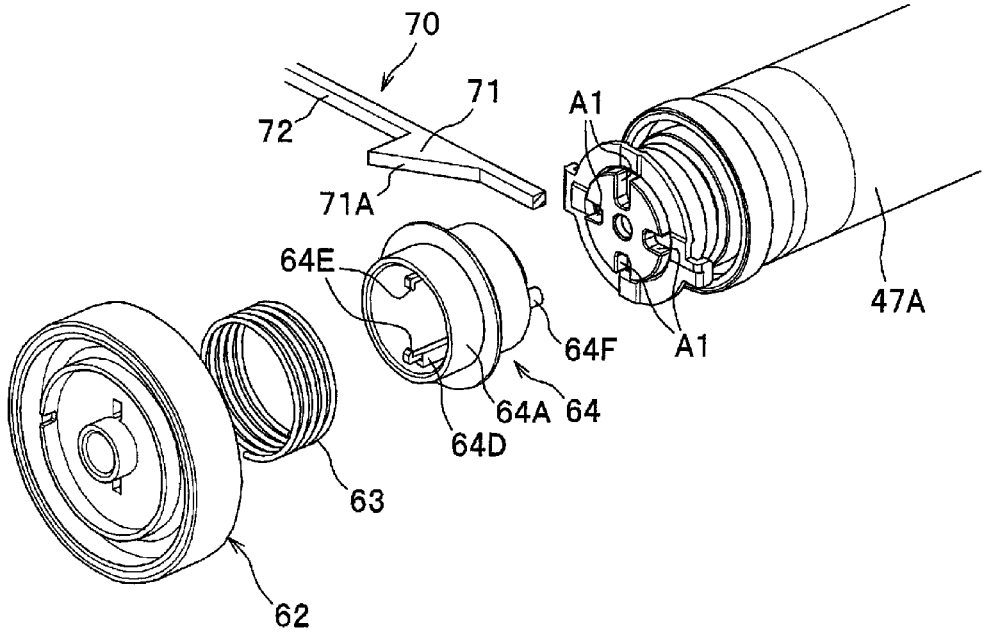
FIG. 3B is an exploded perspective view in which the driving force transmitting mechanism is disassembled when viewed from a main body driving gear side.

As shown in FIGS. 3A and 3B, the coupling 64 is disposed between the main body driving gear 62 and the photosensitive drum 47A and engages with the main body driving gear 62 and the photosensitive drum 47A in the rotation direction, so as to transmit the driving force from the main body driving gear 62 to the photosensitive drum 47A. Specifically, the coupling 64 mostly includes a cylinder portion 64A into which the protrusion 62B of the main body driving gear 62 is inserted, and a wall 64B that closes the end of the cylinder portion 64A facing to the photosensitive drum 47A and is opposed to the photosensitive drum 47A.

On the outer peripheral surface of the cylinder portion 64A, a ring-shaped flange 64C extending outward in the diameter direction is formed, and the ring-shaped flange 64C and the gear portion 62A of the main body driving gear 62 are pressed so as to be separated from each other by the above-described coil spring 63.

On the inner peripheral surface of the cylinder portion 64A, a pair of first convex portions 64D along the rotation axis direction is installed so as to be opposed with the rotation axis interposed therebetween. In addition, the first convex portions 64D are engaged with respect to the first concave portion 62C in the rotation direction in a state of being inserted in the first concave portion 62C of the main body driving gear 62. In other words, in the present embodiment, a first connecting portion is formed of the first convex portion 64D and the first concave portion 62C.

In addition, the first convex portion 64D can be moved in the rotation axis direction with respect to the first concave portion 62C. Namely, the coupling 64 is supported to the main body driving gear 62 so as to be movable in the rotation axis direction, which enables the connection and the disconnection of the coupling 64 and the photosensitive drum 47A to be switched.

In addition, at the ends of each of the first convex portions 64D facing the main body driving gear 62 side, catching hooks 64E as one example of catching portions protruding inward in the diameter direction side are each formed. In addition, as shown in FIG. 4A, each of the catching hooks 64E can be engaged with each of the catching ribs 62E of the main body driving gear 62 in the rotation axis direction, which restricts the movement of the coupling 64 toward the photosensitive drum 47A side (separation from the main body driving gear 62).

In addition, the cylinder portion 64A and the protrusion 62B of the main body driving gear 62 is configured so that a gap can be made in a direction (hereinafter, referred to as "first diameter direction") of the arrangement of two first convex portions 64D when they are fitted into each other. In addition, a gap can be also formed between front ends of each catching hook 64E and the lower surfaces of each of the first concave portions 62C of the main body driving gear 62. As a result, the coupling 64 can be moved in the first diameter direction with respect to the main body driving gear 62.

As shown in FIG. 3A, in the wall 64B, a pair of second convex portions 64F protruding toward the photosensitive drum 47A is installed so as to be opposed to each other with the rotation axis interposed therebetween. Specifically, each of the second convex portions 64F is disposed so as to be opposed to each other in the first diameter direction and a second diameter direction perpendicular to the rotation axis direction and is each formed in a cylindrical shape with a rounded front end. In addition, an aperture 64G is formed at the center portion of the wall 64B. Thus, when the coupling 64 moves in a direction approaching the main body driving gear 62, the intervention of a shaft (not shown) for rotatably supporting the main body driving gear 62 and the wall 64B is prevented.

As shown in FIG. 3B, at the end of the photosensitive drum 47A, four second concave portions A1, which are capable of engaging with each of the second convex portions 64F of the coupling 64, are formed so as to be deviated from each other by 90°. In addition, in a state in which a pair of second convex portions 64F is inserted into a pair of second concave portions A1, the second convex portion 64F and the second concave portion A1 are engaged with each other in the rotation direction. Namely, in the present embodiment, a second connecting portion is formed of the second convex portion 64F and the second concave portion A1.

Figure 4B:
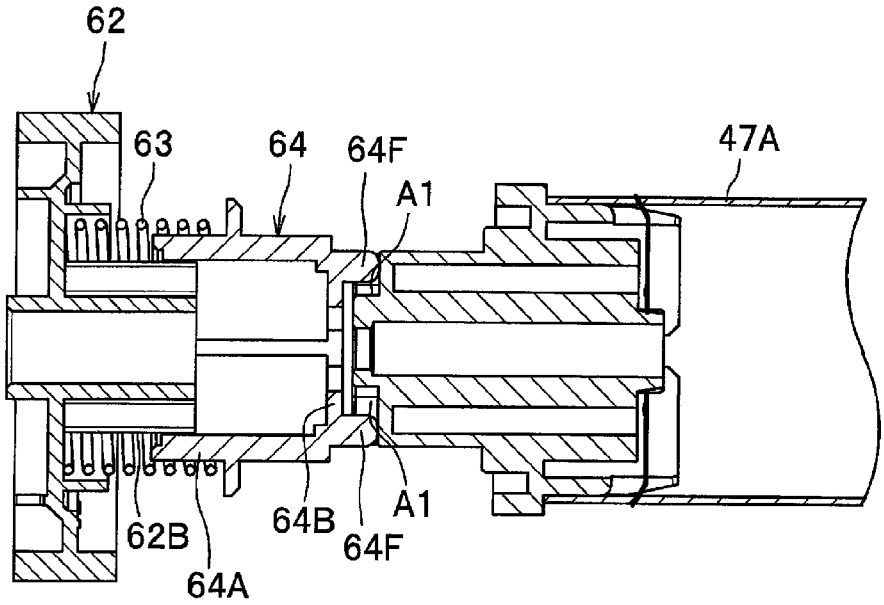
FIG. 4B is a sectional view of the driving force transmitting mechanism taken from a second diameter direction.

In addition, each of the second concave portions A1 is each formed in a groove shape along the diameter direction. Thus, as shown in FIG. 4B, in the state in which a pair of second convex portions 64F is inserted into a pair of second concave portions A1, the coupling 64 can be moved with respect to the photosensitive drum 47A in the second diameter direction (direction in which a pair of second convex portions 64F is arranged).

Furthermore, as shown in FIGS. 3A and 3B, in the apparatus main body 2, a separating mechanism 70 is installed which separates the coupling 64 from the photosensitive drum 47A by pressing the coupling 64 toward the main body driving gear 62. As briefly shown in FIG. 5A, the separating mechanism 70 includes four cams 71, supporting arms 72 for supporting each cam 71, and connecting arms 73 for connecting the supporting arms 72 with the front cover 21. In addition, in FIG. 5, for sake of convenience, the cams 71 are indicated by the hatching of dots.

Figure 6A:
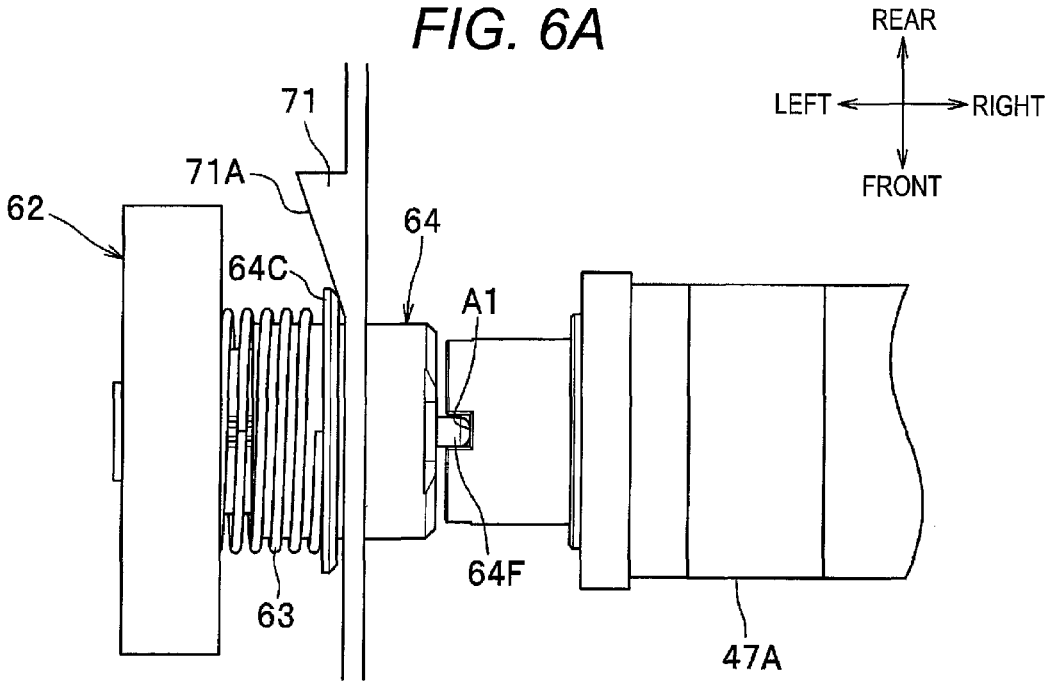
FIG. 6A is a plan view that shows a state in which a coupling is not pressed by a cam.

As shown in FIG. 6A, the cams 71 have inclined surfaces 71A that are inclined toward the left side as they face rearward, and the inclined surfaces 71A are capable of coming in contact with the ring-shaped flange 64C of the coupling 64 in the front and rear direction (direction perpendicular to the rotation axis direction).

Figure 5A:
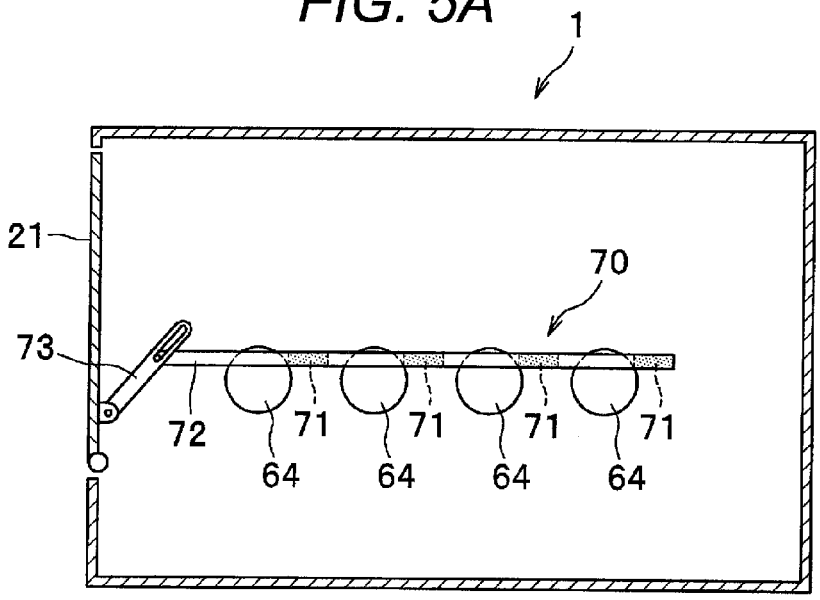
FIGS. 5A and 5B are diagrams that schematically illustrate a separation mechanism.
Figure 5B:
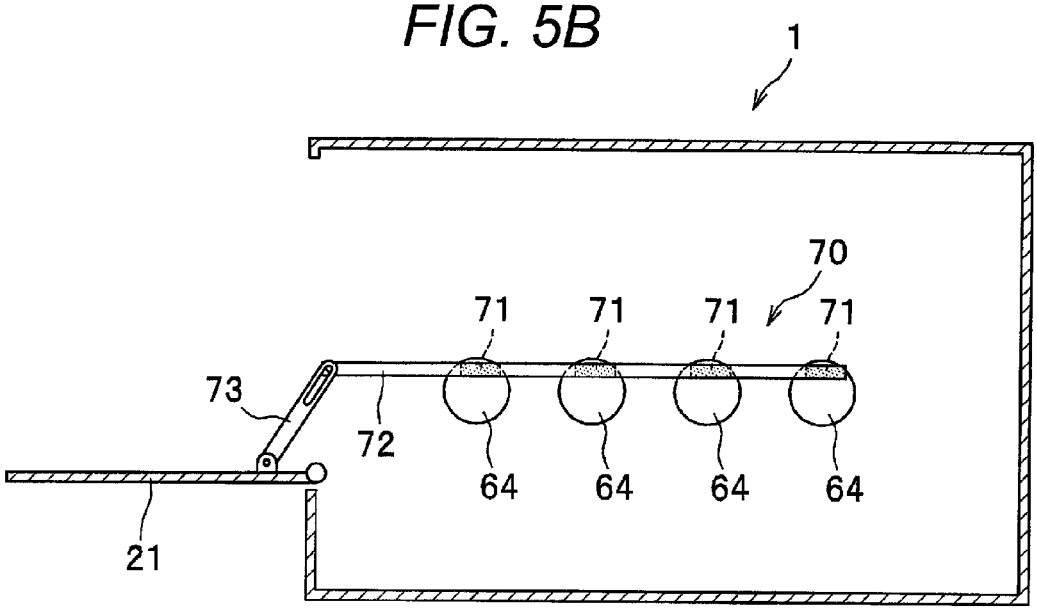
Figure 6B:
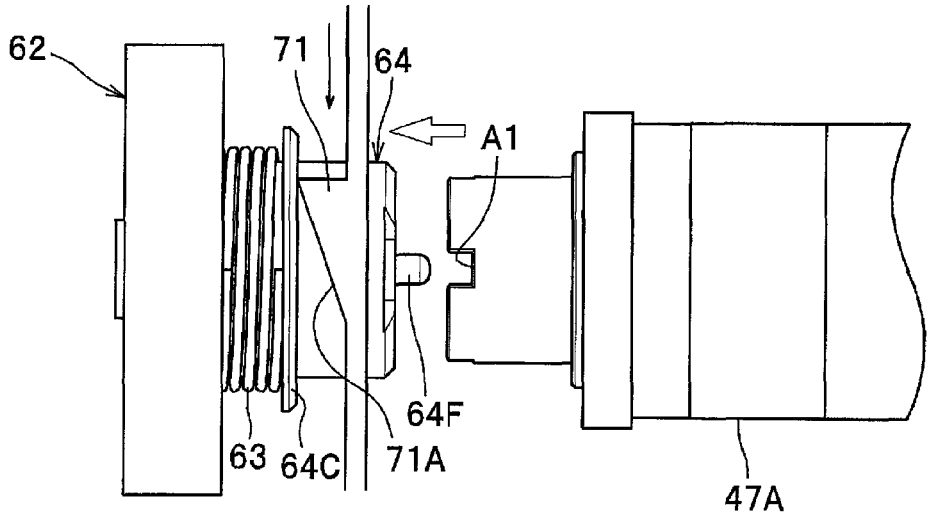
FIG. 6B is a plan view that shows a state in which a coupling is pressed by a cam.

In addition, as shown in FIGS. 5A and 5B, when a user opens the front cover 21, the connecting arms 73 and the supporting arms 72 are tensioned forward in conjunction with the opening operation of the front cover 21 and each cam 71 moves forward. Thus, as shown in FIG. 6B, the ring-shaped flange 64C of the coupling 64 resists the compressing force of the coil spring 63 by the inclined surfaces 71A of the cams 71 and is pressed, and the coupling 64 is removed from the photosensitive drum 47A, thereby making it possible to withdraw the drawer 45.

In addition, when the drawer 45 is moved from the above-described separation position to the accommodation position so as to be mounted in the apparatus main body 2, each photosensitive drum 47A supported by the drawer 45 is opposed to each coupling 64 in the rotation axis direction. In this state, as shown in the order of FIGS. 5B and 5A, when the front cover 21 is closed, as shown in FIG. 6A, each coupling 64 which has been suppressed by each cam 71 is moved to the right side by means of the pressing force of the coil spring 63 and is connected to the photosensitive drum 47A.

At this time, even if the center axis of the photosensitive drum 47A is deviated from the center axis of the main body driving gear 62, since the coupling 64 can be moved in the first diameter direction and the second diameter direction perpendicular thereto in the state that the coupling 64 is engaged with the photosensitive drum 47A and the main body driving gear 62 in the rotation direction, the coupling 64 transmits the driving force while sliding with respect to the photosensitive drum 47A and the main body driving gear 62 like an Oldham's coupling. As a result, it is possible satisfactorily to transmit the force from the main body driving gear 62 via the coupling 64 to the photosensitive drum 47A.

Furthermore, in the present embodiment, in addition to the above-described effects, the following effects can be obtained.

By installing the first concave portion 62C and the first convex portion 64D on the outer peripheral surface of the protrusion 62B of the main body driving gear 62 and the inner peripheral surface of the cylinder portion 64A of the coupling 64, the first concave portion 62C and the first convex portion 64D can be covered with the cylinder portion 64A, thereby making it possible to suppress the deterioration of the sliding movability due to the dust caught between the first concave portion 62C and the first convex portion 64D.

The first concave portion 62C is formed on the outer peripheral surface of the protrusion 62B of the main body driving gear 62 and the first convex portion 64D is formed on the inner peripheral surface of the cylinder portion 64A of the coupling 64. Thus, as compared to the structure in which the convex portion is formed on the outer peripheral surface of the protrusion and the concave portion is formed on the inner peripheral surface of the cylinder portion on the contrary to this, a root portion of the convex portion can be positioned outside in the diameter direction. Herein, since the force applied to the root portion of the convex portion is calculated by torque÷radius, the force applied to the root portion is reduced to the extent that the root portion of the convex portion is positioned outside in the diameter direction. Thus, in the above-described embodiment, since the force applied to the root portion of the first convex portion 64D can be reduced as compared to the reversed structure as described above, the first convex portion 64D is hardly deformed, so the accuracy of the engaging portion of the second component can be maintained and it is possible to always transmit a constant driving force. In addition, the force applied to the root portion of the first convex portion 64D is reduced, which makes it also possible to suppress the bending of the first convex portion 64D.

Since the coil spring 63 is installed which pushes the coupling 64 in the direction separated from the main body driving gear 62, only by installing the cams 71, which press the coupling 64 toward the main body driving gear 62, in the apparatus main body 2, it is possible to advance and retreat the coupling 64 with respect to the photosensitive drum 47A. In other words, since a mechanism, which separates the coupling 64 from the main body driving gear 62, may not be separately installed at the apparatus main body 2, the apparatus can be simplified.

Since the catching ribs 62E installed at the main body driving gear 62 and the catching hooks 64E installed at the coupling 64 restrict the movement of the coupling 64 to the photosensitive drum 47A, it is possible to prevent the coupling 64 from being removed from the main body driving gear 62 due to the pressing force of the coil spring 63.

In addition, the present invention is not limited the above-described embodiment but can be used in various configurations as described hereinafter.

In the above-described embodiment, while the photosensitive drum 47A has been adopted as the passive member, the present invention is not limited thereto, for example a development roller may be used. Meanwhile, in a case where the photosensitive drum is adopted as the passive drum, even if the centers of the axes are deviated from each other, a plurality of photosensitive drums can be always rotated at a regular speed, which makes it possible to prevent the deviation of the colors or the like.

Figure 7A:
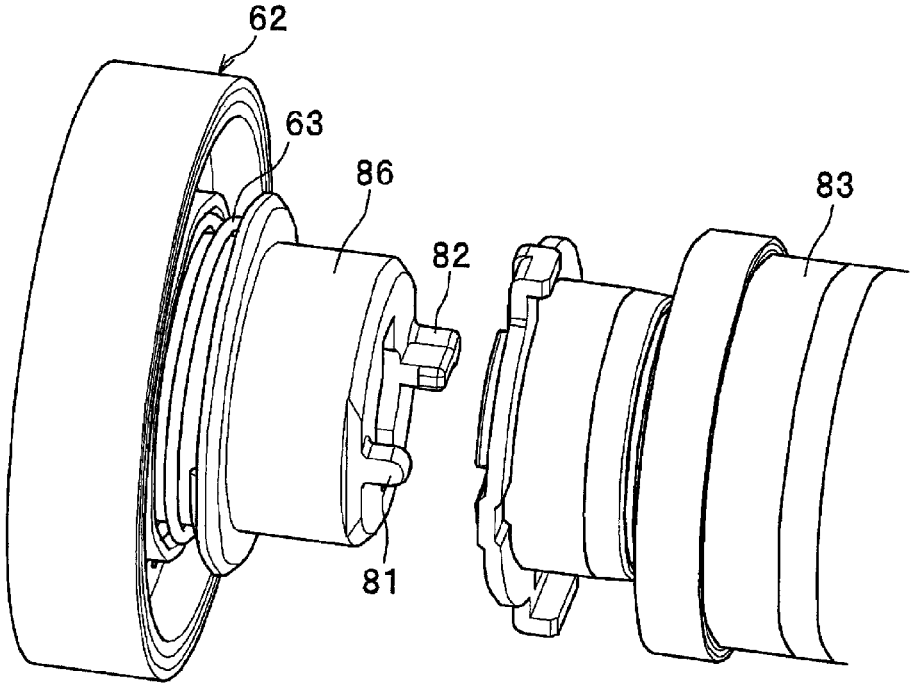
FIGS. 7A and 7B are exploded perspective views that show modified examples of a connecting portion of the coupling and the photosensitive drum.

In the above-describe embodiment, while the convex portions (second convex portion 64F) installed at the driving force transmitting member (coupling 64) have been described as having a cylindrical shape with the rounded front end, the present invention is not limited thereto, two convex portions may be formed in a different shape from each other. For example, as shown in FIG. 7A, one convex portion 81 may be formed in a plate shape with a rounded front end and the other convex portion 82 may be formed to be longer than the convex portion 81 in the diameter direction.

Figure 7B:
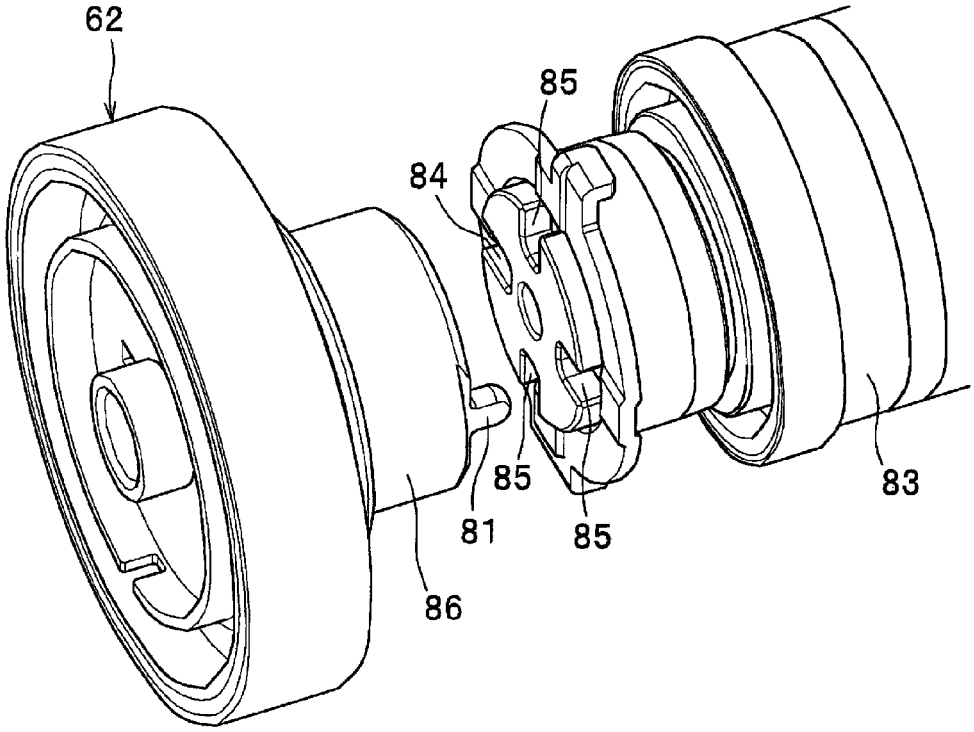

In this case, as shown in FIG. 7B, on the end surface of the photosensitive drum 83, there is formed only one concave portion 84 which is formed to be longer in the diameter direction so as to be able to engage with the other convex portion 82. In addition, the remaining three concave portions 85 are formed to be shorter than the concave portion 84 so as to be unable to engage with the above-described the other convex portion 82 and so as to be able to engage with the above-described one convex portion 81.

According to this, the other convex portion 82 necessarily engages with the concave portion 84, so it is possible to always engage the photosensitive drum 83 with the coupling 86 in the same direction (same phase) in the rotation direction. Thus, even if the drawer 45 is attached or detached, it is possible to always arrange the phases of the plurality of photosensitive drums 83. Furthermore, by engaging the photosensitive drum 83 with the coupling 86 always in the same direction, it is possible to always match the accuracies of the oscillation of the photosensitive drum 83 and the oscillation of the coupling 86 or the like (make them in a certain relationship). Thus, the printing control of good accuracy can be easily performed and a high image quality can be promoted.

While the main body driving gear 62 has been adopted as the main body driving member in the above-describe embodiment, the present invention is not limited thereto, for example, rollers or the like around which the belt is wound so that the driving force is transmitted from the belt may be adopted.

While the concave portion (first concave portion 62C) has been installed at the main body driving member (main body driving gear 62) and the convex portion (first convex portion 64D) has been installed at the driving force transmitting member (coupling 64) in the above-described embodiment, the present invention is not limited thereto, the convex portion may be installed at the main body driving member and the concave portion may be installed at the driving force transmitting member. In addition, on the contrary to the above-described embodiment, the concave portion may be installed at the driving force transmitting member and the convex portion engaging with the concave portion may be installed at the passive portion (photosensitive drum 47A). Furthermore, on the contrary to the above-described embodiment, the cylinder member may be installed at the main body driving member and the protrusion may be installed at the driving force transmitting member.

While the cams 71 have been moved in the front and rear direction in the above-described embodiment, the present invention is not limited thereto, for example, by moving the cams in the up and down direction, the driving force transmitting member may be pressed in the rotation axis direction.

While the coil spring 63 has been adopted as the pressing member in the above-described embodiment, the present invention is not limited thereto, for example, a line spring and a disk spring or the like may be adopted.

While the catching portions (catching rib 62E and catching hook 64E) have been installed at both the main body driving member (main body driving gear 62) and the driving force transmitting member (coupling 64) in the above-described embodiment, the present invention is not limited thereto, the catching portions may be installed in at least one of the main body driving member and the driving force transmitting member. For example, only the catching portion with the hook shape, which extends so as to penetrate the center of the driving force transmitting member from the main body driving member and comes in contact with the end surface of the driving force transmitting member facing the passive member, may be installed.

While the present invention has been applied to the color laser printer 1 in the above-described embodiment, the present invention is not limited thereto, but may be applied to other image forming apparatuses, for example, a copier and a combination device or the like. While the photosensitive drum 47A has been adopted as the photoreceptor in the above-described embodiment, the present invention is not limited thereto, for example, a belt-shaped photoreceptor may be adopted.

Next, a second exemplary embodiment of the present invention will be described in detail with reference to the drawings. In the following description, first of all, the overall structure of a color laser printer as one example of an image forming apparatus according to one embodiment will be briefly described, and thereafter, the characteristic portions of the present invention will be described in detail.

Overall Structure of Color Laser Printer

Figure 8:
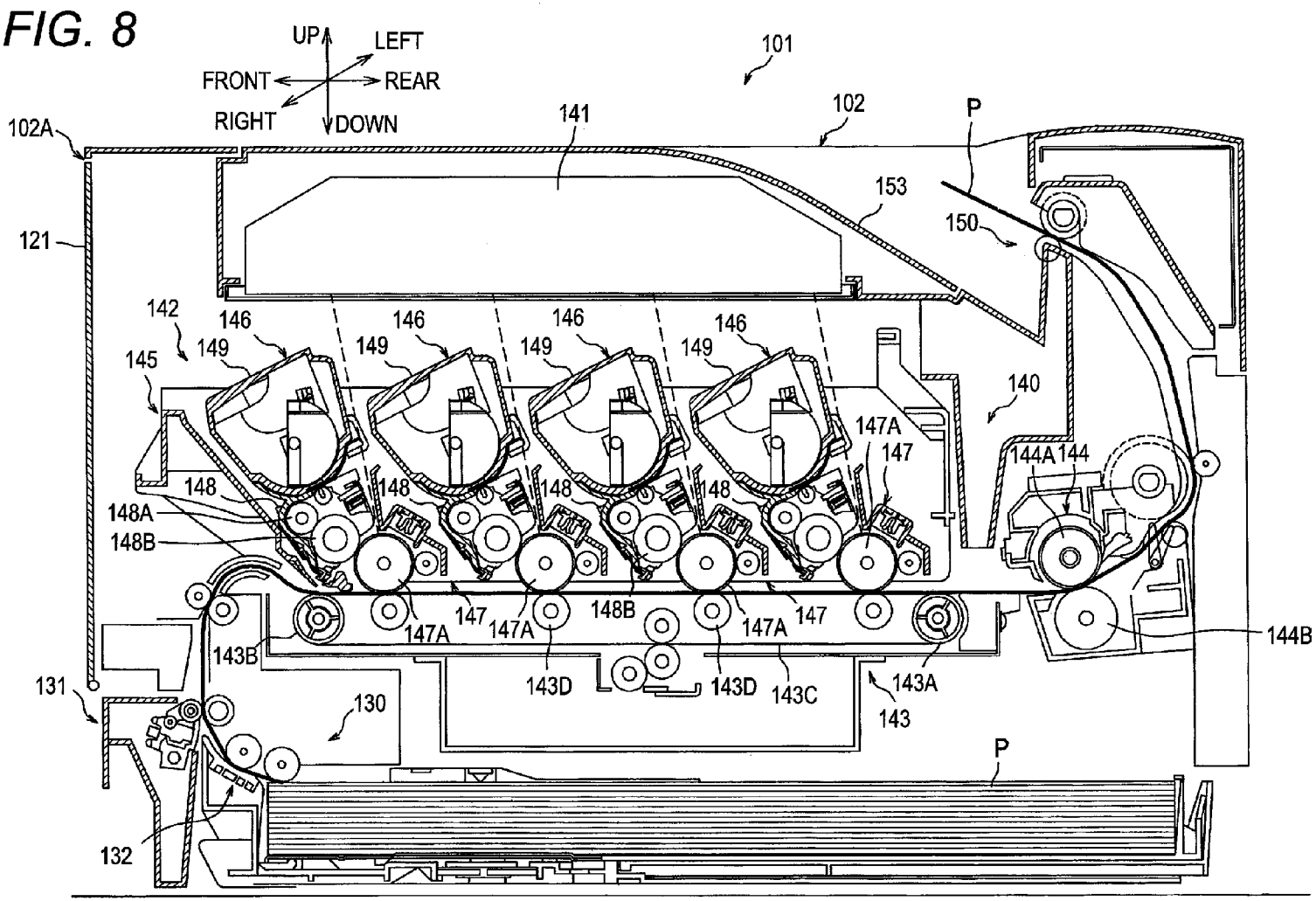
FIG. 8 is a sectional view showing the overall structure of a color laser printer according to the second embodiment.

As shown in FIG. 8, a color laser printer 101 includes a paper feeding portion 130 for feeding papers P into an apparatus main body 102, an image forming unit 140 for forming images on the papers P which have been fed from the paper feeding portion 130, and a paper discharging portion 150 that discharges the papers P removed from the image forming unit 140 from inside the apparatus main body 102.

In addition, directions of up and down, left and right, and front and rear indicated by arrows in FIG. 8 are directions as seen from a person who stands in front of the color laser printer 101, and unless particularly described, in the following description, the directions of up and down, left and right, and front and rear are on the basis of the directions indicated by the arrows in FIG. 8.

In a front wall of the apparatus main body 102, an opening portion 102A for attaching and detaching a drawer 145 as one example of a moving member described later is formed and a front cover 121 for opening and closing the opening portion 102A is installed so as to be rotatable.

The paper feeding portion 130 includes a paper feeding tray 131 that can be attached to and detached from the apparatus main body 102, and a paper feeding mechanism 132 for transporting the papers P from the paper feeding tray 131 to the image forming unit 140.

The image forming unit 140 includes a scanner portion 141, a process portion 142, a transfer portion 143 and a fixing portion 144.

While it is not shown, the scanner portion 141 includes a laser emitting portion, a polygon mirror, a plurality of lenses and reflectors. In the scanner portion 141, laser lights corresponding to each of colors of cyan, magenta, yellow and black are illuminated to each of the photosensitive drums 147A of the process portion 142.

Figure 9:
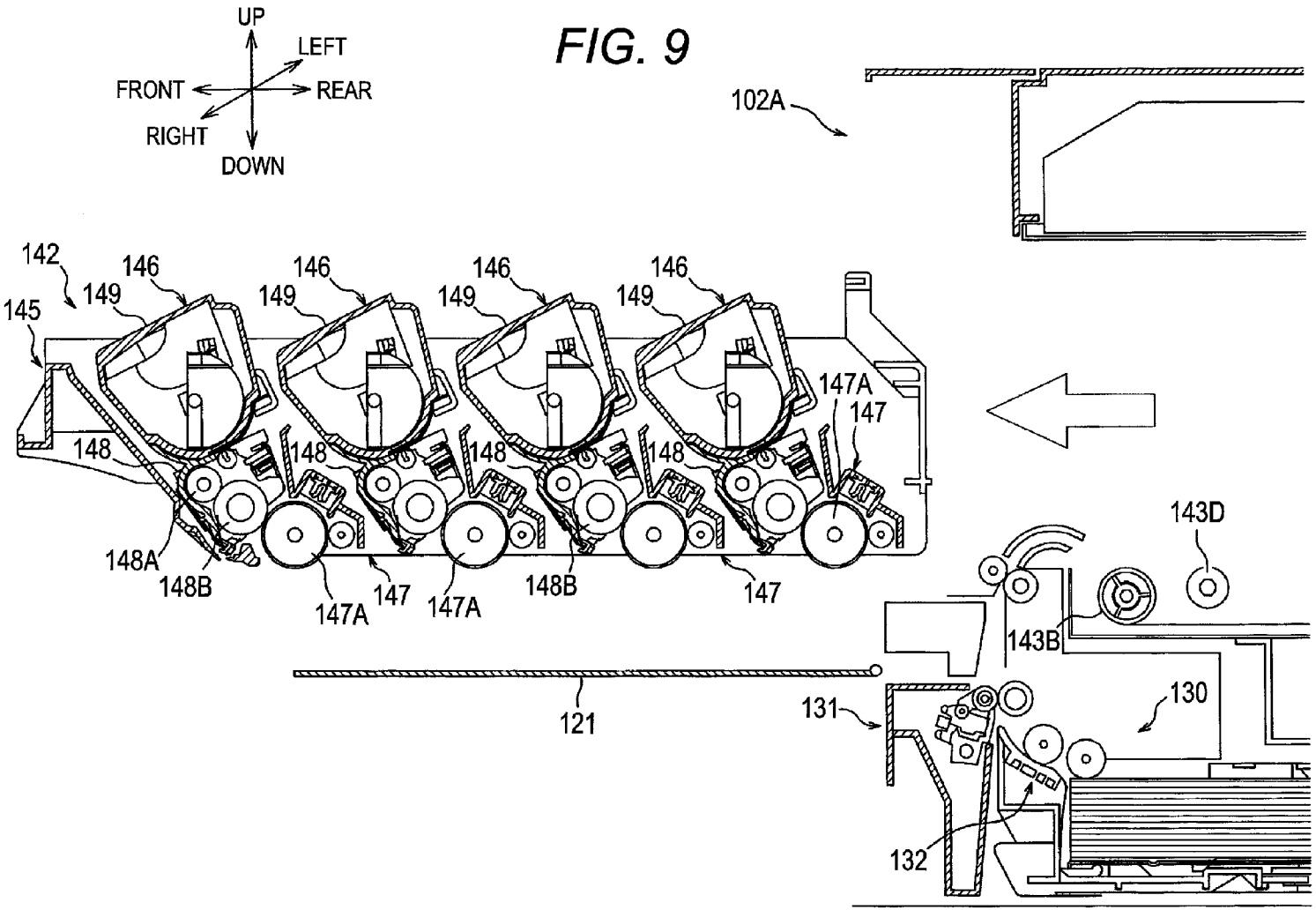
FIG. 9 is a sectional view showing a state in which a drawer is withdrawn from an apparatus main body.

The process portion 142 includes a drawer 145 which is disposed between the scanner portion 141 and the transfer portion 143 and is removably mounted in the apparatus main body 102. The drawer 145 can be moved between an accommodation position (position of FIG. 8) in the apparatus main body 102 and a separation position (position of FIG. 9) out of the apparatus main body 102, in a state in which the front cover 121 is opened. In addition, in the drawer 145, four (plural) process cartridges 146 are arranged along the transport direction of the papers P.

In addition, the "separation position" refers to a position in which the drawer 145 is moved from the "accommodation position". Thus, for example, the drawer 145 may have a structure that can be attached to and detached from the apparatus main body 102 and may have a structure that cannot be detached from the apparatus main body 102.

Each of the process cartridges 146 includes a drum sub unit 147 disposed at a lower portion, a development unit 148 that is removably connected to the drum sub unit 147, and a developing agent cartridge 149 that is removably connected to the development unit 148.

The drum sub unit 147 includes a photosensitive drum 147A as one example of a passive member (photoconductor) and a charger (not shown) or the like. The photosensitive drum 147A is rotatably supported to the drum sub unit 147. In other words, the photosensitive drum 147A is indirectly supported to the drawer 145 via the drum sub unit 147.

The development unit 148 includes a development roller 148B and a supplying roller 148A or the like. In addition, in each of the developing agent cartridges 149, toners (developing agents) of a nonmagnetic one component of each color of cyan, magenta, yellow and black are accommodated.

In the process portion 142 configured as above, the surface of the photosensitive drum 147A charged by the charger is exposed by the laser light emitted from the scanner portion 141, so the electric potential of the exposed portion is lowered and electrostatic latent image based on image data is formed on the photosensitive drum 147A. In addition, the toner is supplied to the electrostatic latent image on the photosensitive drum 147A by means of the development roller 148B contacting the photosensitive drum 147A, so the toner image is carried on the photosensitive drum 147A.

The transfer portion 143C includes a driving roller 143A, a driven roller 143B, a transport belt 143C and a transfer roller 143D. In the transfer portion 143, when the papers P transported by the transport belt 143C are supplied between the photosensitive drum 147A and the transfer roller 143D, the toner image on the photosensitive drum 147A is transferred to the papers P.

The fixing portion 144 includes a heating roller 144A and a pressing roller 144B. In the fixing portion 144, the papers P are transported while being interposed between the heating roller 144A and the pressing roller 144B, so toner images on the papers P are subjected to the heat fixing.

The paper discharging portion 150 has a plurality of transport rollers (not shown) and transports the papers P discharged from the fixing portion 144 to the upper paper discharging tray 153.

Driving Force Transmitting Mechanism to Photosensitive Drum

Next, a driving force transmitting mechanism to the photosensitive drum 147A which is a characteristic portion of the present invention will be described. Furthermore, in FIG. 10, for sake of convenience, the photosensitive drum 147A is rotated and shown in a direction of time so that the end surface of the photosensitive drum 147A is invisible.

Figure 10:
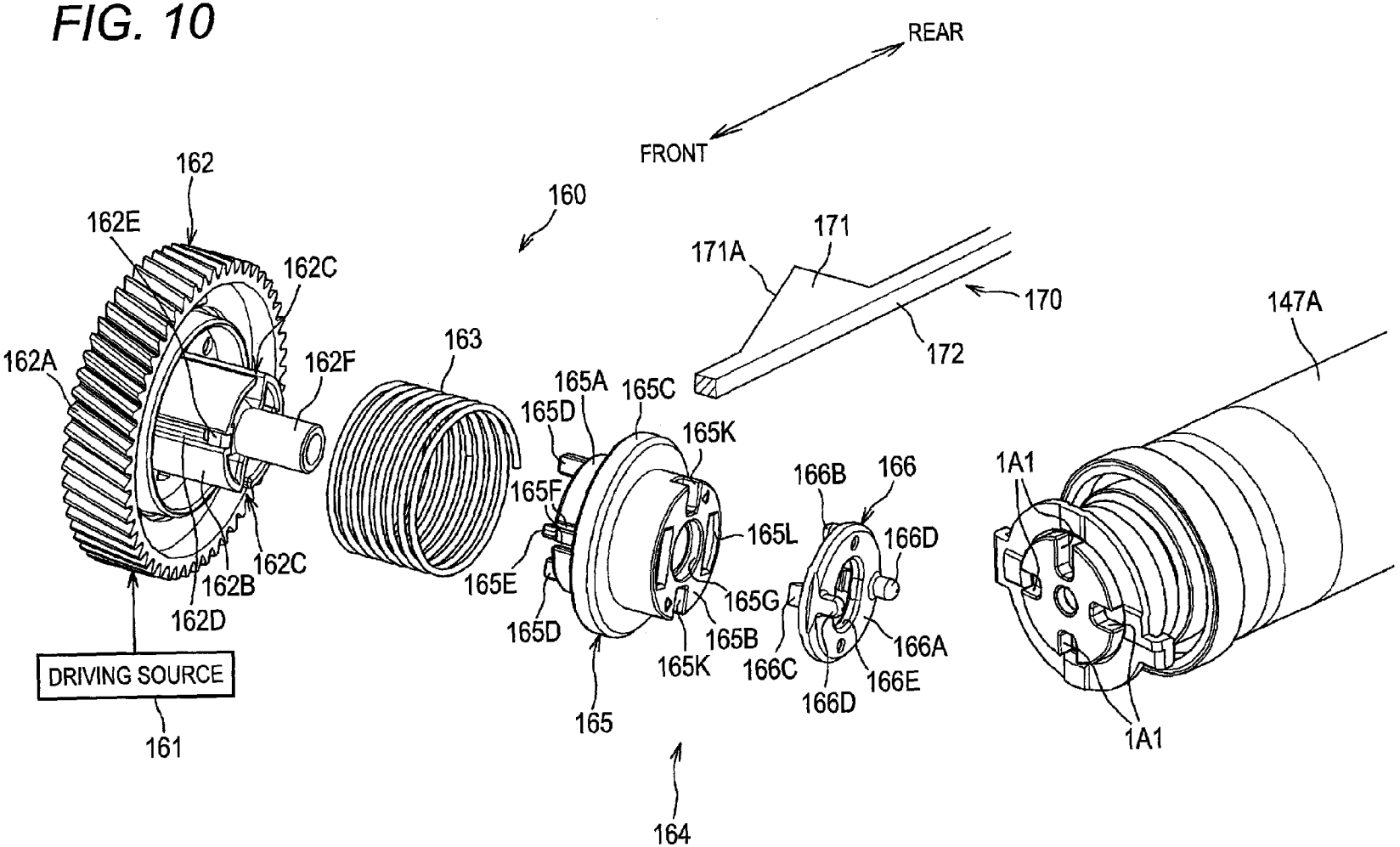
FIG. 10 is an exploded perspective view showing the disassembled driving force transmitting mechanism.

As shown in FIG. 10, a driving force transmitting mechanism 160 for transmitting the driving force to photosensitive drum 147A includes a driving source 161 such as a motor, a main body driving gear 162 as one example of the main body driving member, a coil spring 163 as one example of the pressing member, and a driving force transmitting member 164.

The driving source 161 is installed at a suitable position of the apparatus main body 102 and transmits directly the driving force to the main body driving gear 162 or transmits indirectly to the main body driving gear 162 via gears.

The main body driving gear 162 is rotatably installed in the apparatus main body 102 and includes a gear portion 162A to which a driving force is transmitted from the driving source 161, and a protrusion 162B which is protruded from the center portion of the gear portion 162A toward the driving force transmitting member 164. On the outer peripheral surface of the protrusion 162B, a pair of first concave portions 162C is installed along the axial direction of the main body driving gear 162 so as to be opposed to each other with the rotation axis interposed therebetween. In addition, a pair of engaging concave portions 162D is formed between (position separated from each other in the rotation direction by about 90°) each of the first concave portions 162C among the outer peripheral surfaces of the protrusion 162B.

Figure 11A:
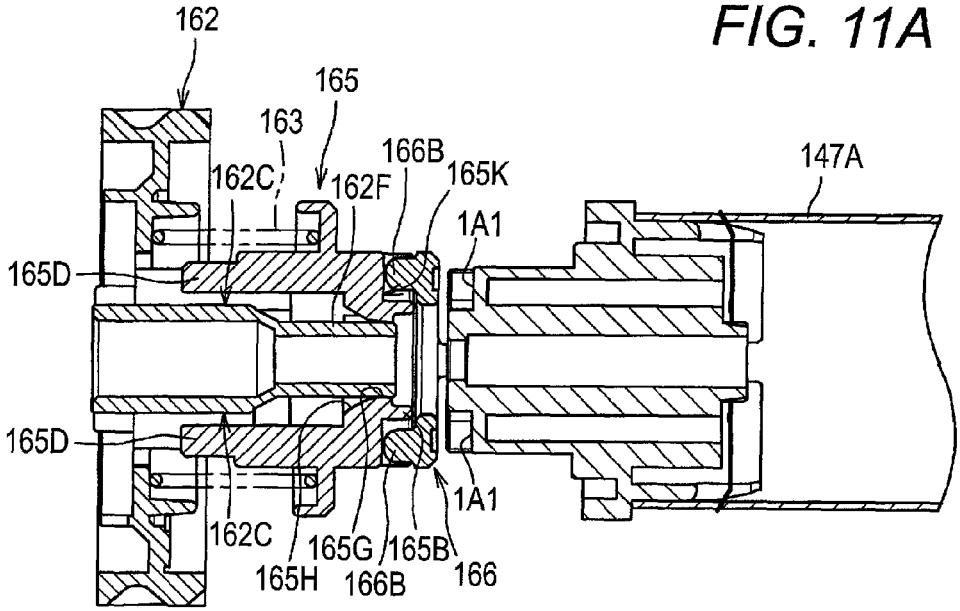
FIG. 11A is a sectional view of the driving force transmitting mechanism taken from a first diameter direction.
Figure 11B:
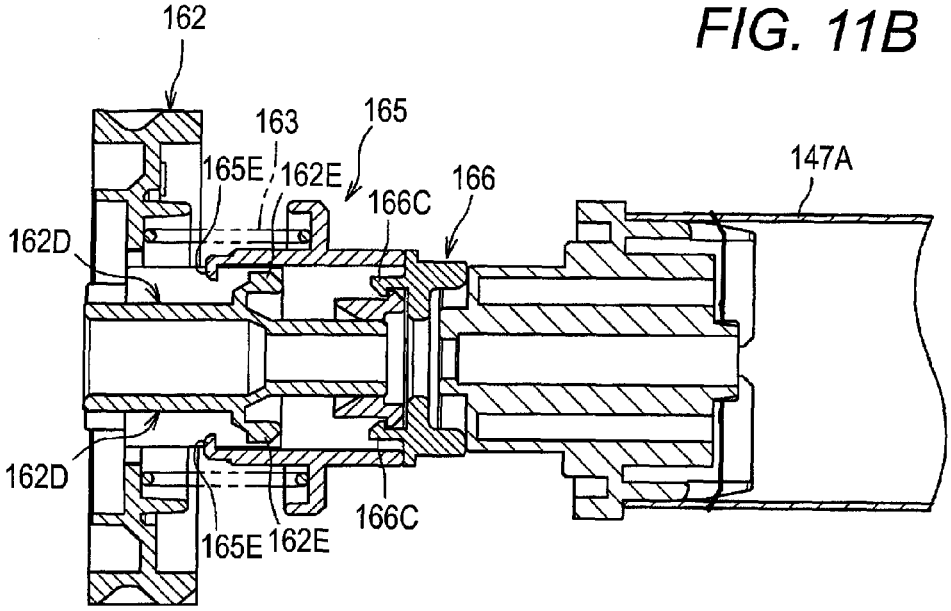
FIG. 11B is a sectional view of the driving force transmitting mechanism taken from a second diameter direction.

In addition, at the ends of each of the engaging concave portions 162D facing the driving force transmitting member 164, catching ribs 162E as one example of catching portion, which protrudes outward in the diameter direction of the main body driving gear 162, are each formed (see FIG. 11B).

Furthermore, at the front end of the protrusion 162B, a cylindrically extended portion 162F which is smaller in diameter than the protrusion 162B is extended so as to be protruded from the front end in the axial direction.

The coil spring 163 is disposed between the main body driving gear 162 and the driving force transmitting member 164 (specifically, coupling member 165 described hereinafter) and presses the main body driving gear 162 and driving force transmitting member 164 in a direction separated from each other.

The driving force transmitting member 164 is disposed between the main body driving gear 162 and the photosensitive drum 147A and engages with the main body driving gear 162 and the photosensitive drum 147A in the rotation direction, thereby transmitting the driving force from the main body driving gear 162 to the photosensitive drum 147A. In addition, the driving force transmitting member 164 is supported to the main body driving gear 162 movably in the axial direction, which makes it possible to switch the connection and disconnection of the driving force transmitting member 64 and the photosensitive drum 47A.

Specifically, the driving force transmitting member 164 has a coupling member 165 disposed at the main body driving gear 162 and an Oldham member 166 disposed at the photosensitive drum 147A.

The coupling member 165 is a member, which is supported to the main body driving gear 162 movably in the axial direction and is engaged therewith in the rotation direction. The coupling member 165 mostly has a cylinder portion 165A into which the protrusion 162B of the main body driving gear 162 is inserted, and a wall 165B that closes the end of the cylinder portion 165A facing to the Oldham member 166 and is opposed to the Oldham member 166.

On the outer peripheral surface of the cylinder portion 165A, a ring-shaped flange 165C extending outward in the diameter direction is formed, and the ring-shaped flange 165C and the gear portion 162A of the main body driving gear 162 are pressed so as to be separated from each other by the above-described coil spring 163.

On the inner peripheral surface of the cylinder portion 165A, a pair of first convex portions 165D along the axial direction is installed so as to be opposed with the rotation axis interposed therebetween. In addition, the first convex portions 165D are relatively movable in the axial direction relative to the first concave portions 162C and are engaged therewith in the rotation direction in a state of being inserted in the first concave portion 162C of the main body driving gear 162.

In addition, between (position separated by about 90° in the rotation direction) each of the first convex portions 165D of the cylinder portion 165A, a pair of catching hook 165E as one example of the catching portion is installed so as to be opposed to each other with the rotation axis interposed therebetween (see FIG. 11B). The catching hooks 165E protrude inward from the inner peripheral surface of the cylinder portion 165A and are inserted into each of the engaging concave portions 162D of the main body driving gear 162, so that the catching hooks 165E are engaged with the catching ribs 162E in the coaxial direction.

In addition, at both sides of the catching hooks 165E in the circumferential direction, a pair of slits 165F is formed which extend in the axial direction and is sunk into the end surface of the cylinder portion 165A. Therefore, when the cylinder portion 165A of the coupling member 165 is fitted into the protrusion 162B of the main body driving gear 162, the catching hooks 165E are satisfactorily bent to jump over the catching ribs 162E and thereafter engaged with the catching ribs 162E in the axial direction. In addition, the catching hooks 165E are engaged with the catching ribs 162E, so the movement of the coupling member 165 to the photosensitive drum 147A is restricted and the removal of the coupling member 165 from the main body driving gear 162 is suppressed.

Figure 11C:
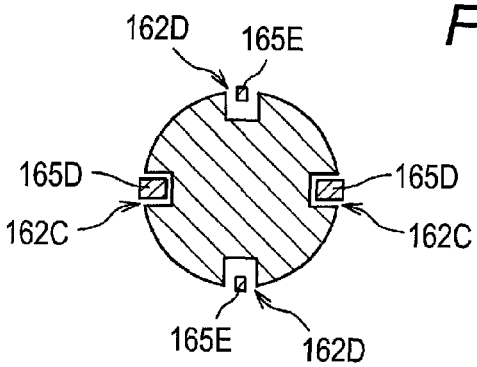
FIG. 11C is a diagram for schematically illustrating the relationship of the engaging hook and the engaging concave portion and the relationship of the first convex portion and the first concave portion.

In addition, as shown in FIG. 11C, the protruding amounts and the widths of the catching hooks 165E are formed to be smaller than those of the first convex portion 165D (convex portion which is not configured as the catching hook), so the catching hooks 165E are formed in a position further separated from the surface of the concave portion (engaging concave portion 162D) than the first convex portion 165D. As a result, when the cylinder portion 165A of the coupling member 165 moves relative to the protrusion 162B of the main body driving gear 162 in the diameter direction or the rotation direction, before the catching hooks 165E come in contact with the engaging concave portion 162D, the first convex portion 165D which is not configured as the catching hook 165E comes in contact with the first concave portion 162C. Thus, the bending of the catching hooks 165E due to contact with the engaging concave portion 162D is prevented by means of the engagement of the first convex portion 165D with the first concave portion 162C.

As shown in FIG. 10, in the center portion of the wall 165B, a circular aperture portion 165G is formed into which the extended portion 162F of the main body driving gear 162 is inserted. As a result, the aperture portion 165G at one end side in the axial direction and the first convex portion 165D at the other side, i.e., both ends of the coupling member 165 are supported by the main body driving gear 162, which makes it possible to stably move the coupling member 165 in the axial direction.

Specifically, as shown in FIG. 11A, the aperture portion 165G is formed in a cylindrical shape with the long length in the axial direction. As a result, the extended portion 162F and the aperture portion 165G come in contact with each other by the face, thereby further stabilizing the movement of the coupling member 165 in the axial direction.

In addition, at the end of the aperture portion 165G facing the main body driving gear 162, a tapered surface 165H in which the diameter thereof is reduced as it faces from the main body driving gear 162 to the Oldham member 166 is formed. As a result, the coupling member 165 is separated from the main body driving gear 162 to the position in which the aperture portion 165G is removed from the extended portion 162F, and even when the coupling member 165 is eccentric with respect to the main body driving gear 162, if the coupling member 165 is pressed toward the main body driving gear 162, the aperture portion 165G is guided by the tapered surface 165H and satisfactorily fitted into the extended portion 162F.

Furthermore, as shown in FIG. 10, a pair of second concave portions 165K and a pair of long apertures 165L are formed in the wall 165B.

The pair of second concave portions 165K is installed so as to opposed in the diameter direction with the aperture portion 165G interposed therebetween and is configured as grooves becoming the wider width along the opposed direction (hereinafter, refereed to as "first diameter direction"). In addition, in each of the second concave portions 165K, a pair of second convex portions 166B, which are formed in an Oldham member 166 described below, is inserted in a state that can be moved in the first diameter direction and engaged with each other in the rotation direction (see FIG. 11). That is to say, in the present embodiment, a first connecting portion is constituted by the second convex portion 166B and the second concave portion 165K.

A pair of long apertures 165L is installed so as to be opposed with each other in a diameter direction (hereinafter, referred to as "second diameter direction") perpendicular to the first diameter direction with the aperture portion 165G interposed therebetween and the length direction of which is formed as a penetration opening along the first diameter direction. Furthermore, at the inner edges of each long aperture 165L, a pair of hook portions 166C, which is formed in an Oldham member 166 described below and can be deformed by bending, can be moved in the first diameter direction and engaged with each other in the axial direction. Consequently, the Oldham member 166 is installed in the coupling member 165, can be moved in the axial direction integrally with the coupling member 165, and can be moved relative to the coupling member 165 in the first diameter direction.

The Oldham member 166 mostly includes a disk-shaped base portion 166A, the above-described pair of second convex portions 166B and the pair of hook portions 166C installed on the surface of the base portion 166A facing the coupling member 165, and a pair of third convex portions 166D installed on the surface of the base portion 166A facing the photosensitive drum 147A.

A long aperture 166E along the first diameter direction is formed in the center portion of the base portion 166A. Thus, even in a case where the driving force transmitting member 164 moves in a direction approaching the main body driving gear 162 in a state in which the Oldham member 166 is eccentric with respect to the coupling member 165 in the first diameter direction, the intervention of the extended portion 162F of the main body driving gear 162 and the Oldham member 166 is prevented (see FIG. 13B).

The pair of second convex portions 166B is installed so as to be opposed to each other in the first diameter direction with the long aperture 166E interposed therebetween and is engaged with the pair of second concave portions 165K of the coupling member 165 as described above. In addition, each of the second convex portions 166B is formed in a hemispherical shape in front end thereof. Thus, when the Oldham member 166 is installed in the coupling member 165, each of the second convex portions 166B is easily inserted into each of the second concave portions 165K.

The pair of hook portions 166C is a hook-shaped protrusion which extends to the coupling member 165 and then is bent inward in the diameter direction. The hook portions 166C are installed so as to be opposed to each other in the second diameter direction with the long aperture 166E interposed therebetween and engaged with the pair of the long aperture 165L of the coupling member 165 as described above.

The pair of third convex portions 166D is installed so as to be opposed to each other in the second diameter direction with the long aperture 166E interposed therebetween. In this regard, on the end surface of the photosensitive drum 147A, four third concave portions 1A1 are formed as long grooves along the diameter direction at the position deviated from each other by approximately 90° so as to interpose the rotation axis of the photosensitive drum 147A therebetween. As a result, in a state in which the pair of the third convex portions 166D is inserted into the pair of the third concaves 1A1 opposed to each other among the four third concaves 1A1, the pair of the third convex portions 166D can be moved in the second diameter direction and can be engaged with each other in the rotation direction. In other words, in the present embodiment, a second connecting portion is constituted by the third convex portions 166D and the pair of the third concaves 1A1.

In addition, the front ends of the third convex portions 166D are formed in a semicircular shape. Thus, the third convex portion 166D is easily inserted into the third concave portion 1A1.

Figure 12A:
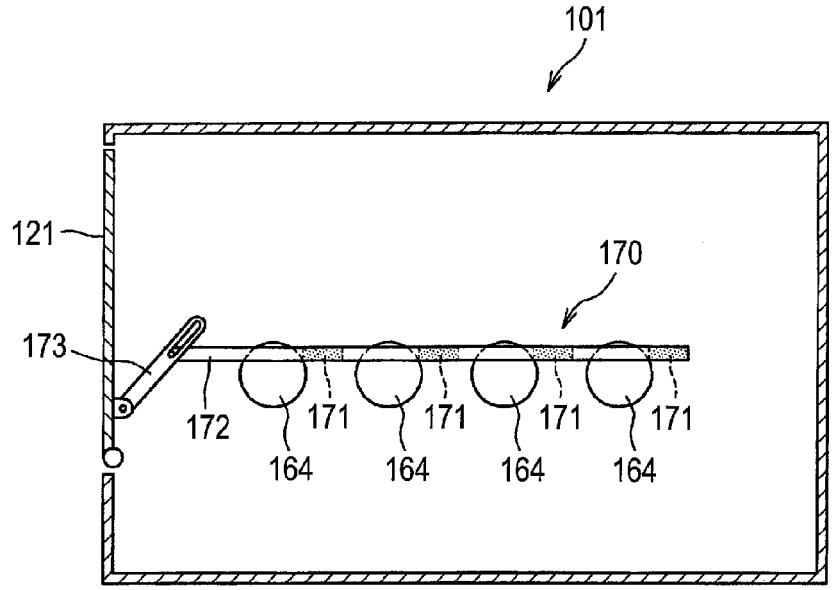
FIGS. 12A and 12B are diagrams that simply show a separation mechanism.

Furthermore, in the apparatus main body 102, a separating mechanism 170 is installed which separates the driving force transmitting member 164 from the photosensitive drum 147A by pressing the driving force transmitting member 164 (specifically, coupling member 165) toward the main body driving gear 162. As shown in FIG. 12A, the separating mechanism 170 includes four cams 171, supporting arms 172 for supporting each cam 171, and connecting arms 173 for connecting the supporting arms 172 with the front cover 121. In addition, in FIG. 12, for sake of convenience, the cams 171 are indicated by the hatching of dots.

As shown in FIG. 10, the cams 171 have inclined surfaces 171A that are inclined toward the left side as they face rearward, and the inclined surfaces 171A are capable of coming in contact with the ring-shaped flange 165C of the coupling member 165 in the front and rear direction (direction perpendicular to the rotation axis direction).

Figure 12B:
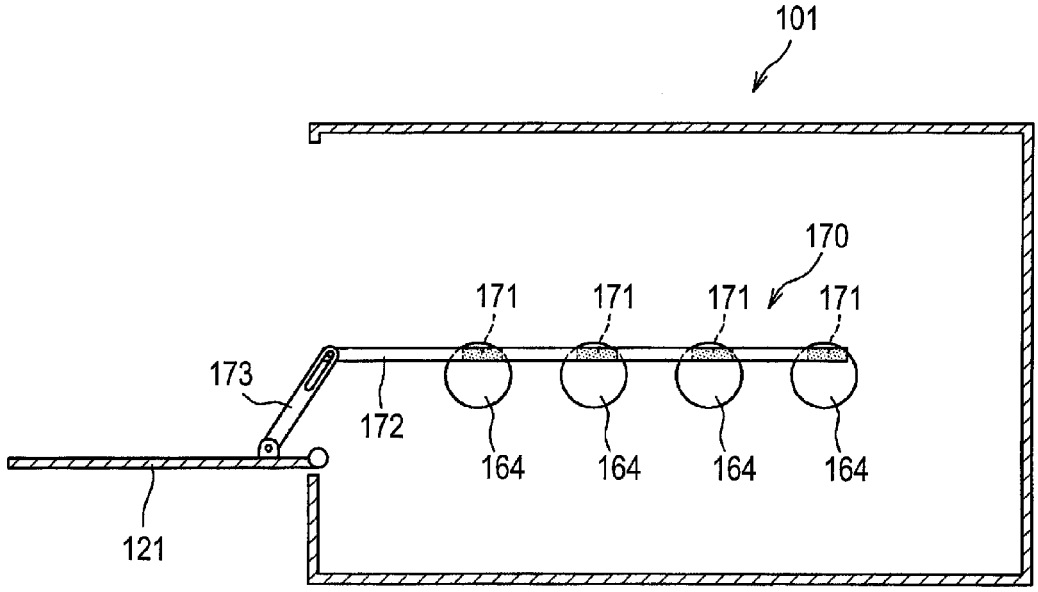

In addition, as shown in FIGS. 12A and 12B, when a user opens the front cover 121, the connecting arms 173 and the supporting arms 172 are tensioned forward in conjunction with the opening operation of the front cover 121 and each cam 171 moves forward. Thus, as shown in FIGS. 13A and 13B, the ring-shaped flange 165C of the coupling member 165 resists the compressing force of the coil spring 163 by the inclined surfaces 171A of the cams 171 and is pressed, and the driving force transmitting member 164 is removed from the photosensitive drum 147A, thereby making it possible to withdraw the drawer 145.

In addition, when the drawer 145 is moved from the above-described separation position to the accommodation position so as to be mounted in the apparatus main body 102, each of the photosensitive drums 147A supported by the drawer 145 positioned at the accommodation position is opposed to each of the driving force transmitting members 164 in the axial direction. In this state, as shown in the order of FIGS. 12B and 12A, when the front cover 121 is closed, as shown in order of FIGS. 13B and 13A, each of the driving force transmitting members 164 which has been suppressed by each cam 171 is moved to the right side by means of the pressing force of the coil spring 163 and is connected to each of the photosensitive drums 147A.

At this time, even if the center axis of the photosensitive drum 147A is deviated from the center axis of the main body driving gear 162, since the Oldham member 166 can be moved in the first diameter direction and the second diameter direction perpendicular thereto in the state in which the Oldham member 166 is engaged with the photosensitive drum 147A and the coupling member 165 in the rotation direction, the Oldham member 166 transmits the driving force while sliding with respect to the photosensitive drum 147A and the main body driving gear 162 like an Oldham's coupling. As a result, it is possible satisfactorily to transmit the driving force from the main body driving gear 162 via the driving force transmitting member 164 to the photosensitive drum 147A.

Figure 13A:
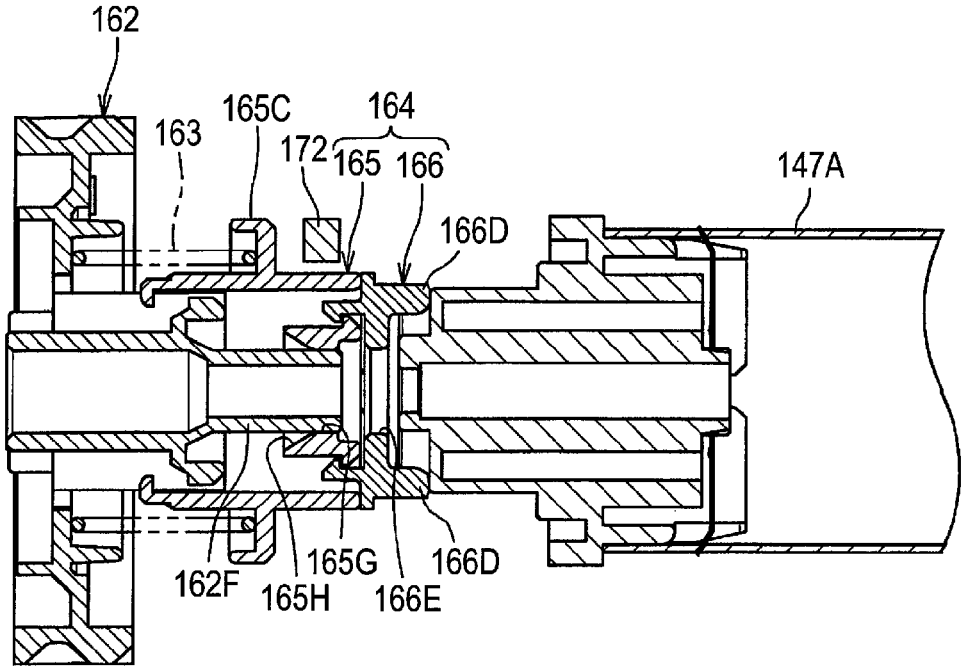
FIG. 13A is a sectional view that shows a state in which a driving force transmitting member is connected to a photosensitive drum.
Figure 13B:
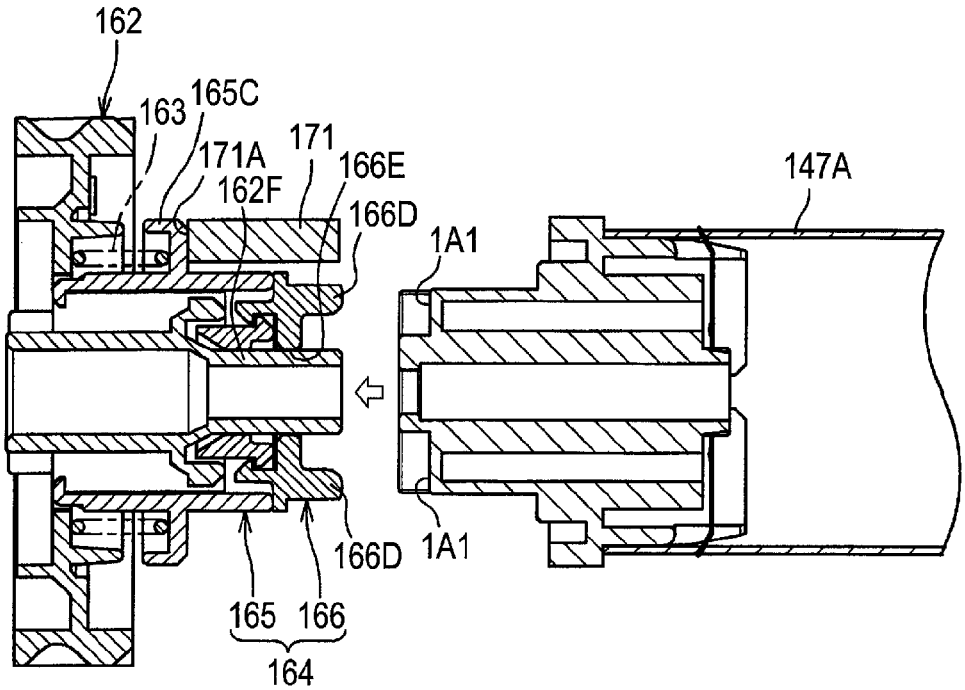
FIG. 13B is a sectional view that shows a state in which a driving force transmitting member is disconnected from to a photosensitive drum.

In addition, when the front cover 121 is closed in a state in which the drawer 145 is removed from the apparatus main body 102, the driving force transmitting member 164 is not supported by the end surface of the photosensitive drum 147A, and thereby is moved to a position, which is further separated from the main body driving gear 162 than the position shown in FIG. 13A, by the pressing force of the coil spring 163 and is pressed by the supporting arm 172. At this time, depending on the arrangement of the supporting arm 172, the coupling member 165 is sometimes removed from the main body driving gear 162 to a position where the aperture portion 165G of the coupling member 165 is separated from the extended portion 162F of the main body driving gear 162. Even in this case, however, as described above, the tapered surface 165H is formed in the aperture portion 165G, thus thereafter, if the coupling member 165 is pressed by the cam 171 according to the opening of the front cover 121, it is possible to satisfactorily lead the aperture portion 165G to the extended portion 162F by means of the tapered surface 165H.

Furthermore, in the present embodiment, in addition to the above-described effects, the following effects can be obtained.

Even by constituting the driving force transmitting member by one component and forming a deep groove which makes the driving force transmitting member movable in the axial direction, it is possible to enable the driving force transmitting member to be moved with respect to the main body driving gear in the axial direction and the first diameter direction, but in this case, the movement in the axial direction is unstable and thereby the driving force transmitting member may not be satisfactorily connected to the photosensitive drum. On the contrary, in the present embodiment, the driving force transmitting member 164 is divided into two components, the coupling member 165 is caused to have the function of moving in the axial direction and the Oldham member 166 is caused to have the function of moving in the first diameter direction. Thus, it is possible to stably move the driving force transmitting member 164 in the axial direction and securely connect the driving force transmitting member 64 to the photosensitive drum 147A.

By installing the first concave portion 162C and the first convex portion 165D on the outer peripheral surface of the protrusion 162B of the main body driving gear 162 and the inner peripheral surface of the cylinder portion 165A of the coupling member 165, the first concave portion 162C and the first convex portion 165D can be covered with the cylinder portion 165A, thereby making it possible to suppress the deterioration of the sliding movability due to the dust caught between the first concave portion 162C and the first convex portion 165D.

Since both ends (end portion of the cylinder portion 165A and aperture portion 165G) of the coupling member 165 in the axial direction are supported by the protrusion 162B of the main body driving gear 162 and the extended portion 162F, it is possible to move the coupling member 165 more stably in the axial direction.

The first concave portion 162C is formed on the outer peripheral surface of the protrusion 162B of the main body driving gear 162 and the first convex portion 165D is formed on the inner peripheral surface of the cylinder portion 165A of the coupling member 165. Thus, as compared to the structure in which the convex portion is formed on the outer peripheral surface of the protrusion and the concave portion is formed on the inner peripheral surface of the cylinder portion on the contrary to this, a root portion of the convex portion can be positioned outside in the diameter direction. Herein, since the force applied to the root portion of the convex portion is calculated by torque÷radius, the force applied to the root portion is reduced to the extent that the root portion of the convex portion is positioned outside in the diameter direction. Thus, in the above-described embodiment, since the force applied to the root portion of the first convex portion 165D can be reduced as compared to the reversed structure as described above, the first convex portion 165D is hardly deformed, so the accuracy of the engaging portion of the second component can be maintained and it is possible to always transmit a constant driving force. In addition, the force applied to the root portion of the first convex portion 165D is reduced, which makes it also possible to suppress the bending of the first convex portion 165D.

Since the coil spring 163 is installed which pushes the driving force transmitting member 164 (coupling member 165) in the direction separated from the main body driving gear 162, only by installing the cams 171, which press the driving force transmitting member 164 toward the main body driving gear 162, in the apparatus main body 102, it is possible to advance and retreat the driving force transmitting member 164 with respect to the photosensitive drum 147A. In other words, since a mechanism, which separates the driving force transmitting member 164 from the main body driving gear 162, may not be separately installed at the apparatus main body 102, the apparatus can be simplified.

Since the catching ribs 162E installed at the main body driving gear 162 and the catching hooks 165E installed at the coupling member 165 restrict the movement of the coupling member 165 to the photosensitive drum 147A, for example, it is possible to prevent the coupling member 165 from being removed from the main body driving gear 162 due to the pressing force of the coil spring 163, for example, at the time of assembling.

Since the catching hook 165E is formed at the position further separated from the surface of the concave portion (engaging concave portion 162D) than the first convex portion 165D, before the catching hook 165E comes in contact with the engaging concave portion 162D, the first convex portion 165D which is not configured as the catching hook 165E comes in contact with the first concave portion 162C. Thus, it is possible to prevent the bending of the catching hook 165E due to the contact with the engaging concave portion 162D.

In addition, the present invention is not limited the above-described embodiment, but can be used in various configurations as described hereinafter.

In the above-described embodiment, while the photosensitive drum 147A has been adopted as the passive member, the present invention is not limited thereto, for example a development roller or the like may be adopted. Meanwhile, in a case where the photoconductor is adopted as the passive drum, even if the centers of the axes are deviated from each other, a plurality of photoconductors can be always rotated at a regular rotation speed, which makes it possible to prevent the deviation of the colors or the like.

While the drawer 145 has been adopted as the moving member in the above-described embodiment, the present invention is not limited thereto, for example, in a case where the plurality of process cartridges can be attached to and detached from the apparatus main body, each of the process cartridges may be each adopted as the moving member.

While the coupling member 165 has been pressed by the separating member 170 in the above-described embodiment, the present invention is not limited thereto, but may be configured so as to press the Oldham member. Furthermore, in this case, for example, the Oldham member may be formed with a flange portion which extends outward in the diameter direction and the flange portion may be pressed by the cam.

While the pair of third convex portions 166D of the Oldham member 166 has been described as each having a cylindrical shape with the rounded front end in the above-described embodiment, the present invention is not limited thereto, but the pair of third convex portions may be each formed in the different shapes from each other and the third concave portions corresponding thereto may be formed on the end surface of the photosensitive drum. According to this, the photosensitive drum can be always engaged with the Oldham member in the same direction (same phase) in the rotation direction. Thus, even if the drawer is attached or detached, it is possible to always arrange the phases of the plurality of photosensitive drums. Furthermore, by engaging the photosensitive drum with the Oldham member always in the same direction in this manner, it is possible to always match the accuracies of the oscillation of the photosensitive drum and the oscillation of the driving force transmitting member or the like (make them in a certain relationship). Thus, the printing control of good accuracy can be easily performed and a high image quality can be promoted.

While the main body driving gear 162 has been adopted as the main body driving member in the above-describe embodiment, the present invention is not limited thereto, for example, rollers or the like around which the belt is wound so that the driving force is transmitted from the belt may be adopted.

The relationship of the unevenness in the above-described embodiment may be each reversed. That is to say, for example, the concave portion may be formed in the Oldham member and the convex portion engaging with the concave portion may be installed in the passive member (photosensitive drum 147A). In addition, on the contrary to the above-described embodiment, the cylinder portion may be installed in the main body driving member and the protrusion may be installed in the driving force transmitting member.

While the cams 171 have been moved in the front and rear direction in the above-described embodiment, the present invention is not limited thereto, for example, by moving the cams in the up and down direction, the driving force transmitting member may be pressed in the axial direction.

While the coil spring 163 has been adopted as the pressing member in the above-described embodiment, the present invention is not limited thereto, for example, a line spring and a disk spring or the like may be adopted.

While the catching portions (catching rib 162E and catching hook 165E) have been installed at both the main body driving member (main body driving gear 162) and the driving force transmitting member (driving force transmitting member 164) in the above-described embodiment, the present invention is not limited thereto, but the catching portions may be installed in at least one of the main body driving member and the driving force transmitting member. For example, only the catching portion with the hook shape, which extends so as to penetrate the center of the driving force transmitting member from the main body driving member and comes in contact with the end surface of the driving force transmitting member facing the passive member, may be installed.

While the present invention has been applied to the color laser printer 101 in the above-described embodiment, it may be applied to other image forming apparatus, for example, a copier and a multi-function device or the like. While the photosensitive drum 147A has been adopted as the photoconductor in the above-described embodiment, the present invention is not limited thereto, for example, a belt-shaped photoconductor may be adopted.

What is claimed is:

1. An image forming apparatus comprising:

an apparatus main body;

a moving member that is movable between an accommodation position in the apparatus main body and a separation position out of the apparatus main body;

a main body driving member that is rotatably provided in the apparatus main body and to which a driving force of a driving source is transmitted;

a passive member that is rotatably provided in the moving member and is opposed to the main body driving member in a rotation axis direction of the main body driving member when the moving member is positioned at the accommodation position; and a driving force transmitting member that is provided between the main body driving member and the passive member, the driving force transmitting member configured to transmit the driving force from the main body driving member to the passive member by engaging with the main body driving member and the passive member in the rotation direction, wherein the driving force transmitting member is movably supported in the main body driving member along the rotation axis direction so as to switch a connection or disconnection of the driving force transmitting member and the passive member, wherein a first connecting unit, by which the main body driving member engages with the driving force transmitting member in the rotation direction, is engaged with the main body driving member and the driving force transmitting member by an unevenness so as to be movable in a first diameter direction perpendicular to the rotation axis direction, and wherein a second connecting unit, by which the driving force transmitting member engages with the passive member in the rotation direction, is engaged with the driving force transmitting member and the passive member by an unevenness so as to be movable in a second diameter direction perpendicular to the rotation axis direction and the first diameter direction.

2. The image forming apparatus according to claim 1, wherein one of the main body driving member and the driving force transmitting member has a protrusion protruding toward the other thereof, the other thereof has a cylinder portion into which the protrusion is inserted, wherein when the protrusion and the cylinder portion are fitted into each other, a gap is formed between the protrusion and the cylinder portion in the first diameter direction, wherein the first connecting unit is configured by an unevenness formed on an outer peripheral surface of the protrusion and on an inner peripheral surface of the cylinder portion.

3. The image forming apparatus according to claim 2, wherein the protrusion is provided on the main body driving member, the cylinder portion is provided on the driving force transmitting member, a first concave portion is provided along the rotation axis direction on the outer peripheral surface of the protrusion, and a first convex portion is provided along the rotation axis direction on the inner peripheral surface of the cylinder portion.

4. The image forming apparatus according to claim 3, wherein the driving force transmitting member includes a wall that closes an end portion of the cylinder portion facing the passive member and is opposed to the passive member, and wherein the second connecting unit is configured by a second convex portion, which is provided in one of the wall and the passive member, and a second concave portion which is provided in the other thereof and is engaged with the second convex portion.

5. The image forming apparatus according to claim 1, further comprising, a separating mechanism that separates the driving force transmitting member from the passive member by pressing the driving force transmitting member toward the main body driving member.

6. The image forming apparatus according to claim 5, further comprising, an opening portion that is formed in the apparatus main body so as to move the moving member from the accommodation position to the separation position; and a cover for opening and closing the opening portion, wherein the separating mechanism includes a cam, which moves in a direction perpendicular to the rotation axis direction in accordance with an opening operation of the cover, and is configured such that the cam presses the driving force transmitting member toward the main body driving member.

7. The image forming apparatus according to claim 5, wherein a pressing member is provided between the main body driving member and the driving force transmitting member, and a catching portion is provided in at least one of the main body driving member and the driving force transmitting member, the pressing member pressing the main body driving member and the driving force transmitting member in separate directions from each other, and the catching portion restricting a movement of the driving force transmitting member to a position close to the passive member.

8. The image forming apparatus according to claim 1, wherein the passive member is a photosensitive drum on which an electrostatic latent image is formed.

9. An image forming apparatus comprising:

an apparatus main body;

a moving member that is movable between an accommodation position in the apparatus main body and a separation position out of the apparatus main body;

a main body driving member that is rotatably provided in the apparatus main body and to which a driving force of a driving source is transmitted;

a passive member that is rotatably provided in the moving member and is opposed to the main body driving member in an axial direction of the main body driving member when the moving member is positioned at the accommodation position; and a driving force transmitting member that is disposed between the main body driving member and the passive member, the driving force transmitting member transmitting the driving force from the main body driving member to the passive member by engaging with the main body driving member and the passive member in the rotation direction, wherein the driving force transmitting member is configured to be movable to the main body driving member along the axial direction so as to switch a connection or a disconnection of the driving force transmitting member and the passive member, wherein the driving force transmitting member includes:

a coupling member that is disposed in a position close to the main body driving member; and an Oldham member that is disposed at a position close to the passive member, wherein the coupling member is supported in the main body driving member so as to be movable along the axial direction and is engaged with the main body driving member in the rotation direction, wherein the Oldham member is attached on the coupling member so as to be movable along the axial direction with the coupling member, and the Oldham member is configured to be engageable with the coupling member and the passive member in the rotation direction, wherein a first connecting unit, by which the coupling member engages with the Oldham member in the rotation direction, is engaged with the coupling member and the Oldham member by an unevenness so as to be movable in a first diameter direction perpendicular to the axial direction, and wherein a second connecting unit, by which the Oldham member engages with the passive member in the rotation direction, is engaged with the Oldham member and the passive member by an unevenness so as to be movable in a second diameter direction perpendicular to the axial direction and the first diameter direction.

10. The image forming apparatus according to claim 9, wherein one of the main body driving member and the coupling member has a protrusion protruding toward the other thereof, the other thereof has a cylinder portion into which the protrusion is inserted is installed, and wherein an unevenness is provided on an outer peripheral surface of the protrusion and on an inner peripheral surface of the cylinder portion, the protrusion and the cylinder portion are movable relative to each other along the axial direction through the unevenness, and the protrusion and the cylinder portion are engaged with each other in the rotation direction by the unevenness.

11. The image forming apparatus according to claim 10, wherein the main body driving member includes the protrusion and an extended portion that extends from the protrusion in the axial direction, and wherein the coupling member includes the cylinder portion, a wall that closes an end portion of the cylinder portion facing the Oldham member, and an aperture portion which is formed in the wall and into which the extended portion is inserted.

12. The image forming apparatus according to claim 10, wherein a first concave portion is provided along the axial direction on the outer peripheral surface of the protrusion, and wherein a first convex portion is provided along the axial direction on the inner peripheral surface of the cylinder portion.

13. The image forming apparatus according to claim 12, wherein the first connecting unit is configured by a second convex portion and a second concave portion, the second convex portion being provided in one of the wall and the Oldham member, and the second concave portion being provided in the other thereof and engaged with the second convex portion, and wherein the second connecting unit is configured by a third convex portion and a third concave portion, the third convex portion being provided in one of the Oldham member and the passive member, and the third concave portion being provided in the other thereof and engaged with the third convex portion.

14. The image forming apparatus according to claim 10, further comprising, a separating mechanism that separates the driving force transmitting member from the passive member by pressing the driving force transmitting member toward the main body driving member.

15. The image forming apparatus according to claim 14, further comprising, an opening portion that is formed in the apparatus main body so as to move the moving member from the accommodation position to the separation position; and a cover for opening and closing the opening portion, wherein the separating mechanism includes a cam, which moves in a direction perpendicular to the axial direction in accordance with the opening operation of the cover, and is configured such the driving force transmitting member is pressed toward the main body driving member by the cam.

16. The image forming apparatus according to claim 14, wherein a pressing member is provided between the main body driving member and the coupling member, and a catching portion is provided in at least one of the main body driving member and the coupling member, the pressing member pressing the main body driving member and the coupling member in separate directions from each other, and the catching portion restricting a movement of the coupling member to the passive member.

17. The image forming apparatus according to claim 16, wherein the unevenness, which is formed on the outer peripheral surface of the protrusion and the inner peripheral surface of the cylinder portion, is configured by a plurality of convex portions disposed separately from each other in the rotation direction and a plurality of concave portions into which the plurality of convex portions is inserted, wherein a part of the plurality of convex portions is the catching portion, and wherein when the cylinder portion moves in the diameter direction or the rotation direction relative to the protrusion, the catching portion is formed at a position further separated from the surface of the concave portion than the convex portion which is not constituted as the catching portion so that the convex portion which is not constituted as the catching portion, comes in contact with the concave portion, before the catching portion comes in contact with the concave portion.

18. The image forming apparatus according to claim 9, wherein the passive member is a photosensitive drum on which an electrostatic latent image is formed.

* * * * *